US011248559B2

(12) United States Patent
Notarnicola et al.

(10) Patent No.: US 11,248,559 B2
(45) Date of Patent: Feb. 15, 2022

(54) CLOSED CYCLE ENGINE WITH BOTTOMING-CYCLE SYSTEM

(71) Applicant: General Electric Company, Schenectady, NY (US)

(72) Inventors: Michael Robert Notarnicola, Cincinnati, OH (US); Joshua Tyler Mook, Loveland, OH (US); Kevin Michael VandeVoorde, Cincinnati, OH (US); Aigbedion Akwara, Cincinnati, OH (US); Mohammed El Hacin Sennoun, West Chester, OH (US); Mary Kathryn Thompson, Fairfield Township, OH (US)

(73) Assignee: General Electric Company, Schenectady, NY (US)

( * ) Notice: Subject to any disclaimer, the term of this patent is extended or adjusted under 35 U.S.C. 154(b) by 1 day.

(21) Appl. No.: 16/899,650

(22) Filed: Jun. 12, 2020

(65) Prior Publication Data

US 2020/0370507 A1 Nov. 26, 2020

Related U.S. Application Data

(63) Continuation of application No. 16/417,787, filed on May 21, 2019, now Pat. No. 10,711,733.

(51) Int. Cl.
*F02G 1/044* (2006.01)
*F02G 1/05* (2006.01)
(Continued)

(52) U.S. Cl.
CPC ..... *F02G 1/0445* (2013.01); *F01K 23/08* (2013.01); *F02G 1/045* (2013.01); *F02G 1/05* (2013.01);
(Continued)

(58) Field of Classification Search
CPC ..... F02G 1/04; F02G 1/043; F02G 1/0435; F02G 1/044; F02G 1/0445; F02G 1/053;
(Continued)

(56) References Cited

U.S. PATENT DOCUMENTS 3,296,808 A 1/1967 Malik
3,552,120 A 1/1971 Beale
(Continued)

FOREIGN PATENT DOCUMENTS

CN 104763553 A * 7/2015
CN 104763553 A 7/2015

OTHER PUBLICATIONS

American Stirling Company, Regenerators, 10 Pages. https://www.stirlingengine.com/regenerators/.
(Continued)

*Primary Examiner* — Mark A Laurenzi
*Assistant Examiner* — Xiaoting Hu
(74) *Attorney, Agent, or Firm* — Dority & Manning, P.A.

(57) ABSTRACT

Systems and methods for converting energy are provided. In one aspect, the system includes a closed cycle engine defining a cold side. The system also includes a bottoming-cycle loop. A pump is operable to move a working fluid along the bottoming-cycle loop. A cold side heat exchanger is positioned along the bottoming-cycle loop in a heat exchange relationship with the cold side of the closed cycle engine. A constant density heat exchanger is positioned along the bottoming-cycle loop downstream of the cold side heat exchanger and upstream of an expansion device. The constant density heat exchanger is operable to hold a volume of the working fluid flowing therethrough at constant density while increasing, via a heat source, the temperature and pressure of the working fluid. The expansion device receives the working fluid at elevated temperature and pressure and
(Continued)

extracts thermal energy from the working fluid to produce work.

19 Claims, 19 Drawing Sheets

(51) Int. Cl.

| | |
|---|---|
| ***F02G 1/057*** | (2006.01) |
| ***F02G 1/055*** | (2006.01) |
| ***F01K 23/08*** | (2006.01) |
| ***F02G 1/045*** | (2006.01) |
| ***F01K 25/10*** | (2006.01) |
| ***F02G 1/043*** | (2006.01) |
| ***F02G 1/06*** | (2006.01) |

(52) U.S. Cl.
CPC ..... *F02G 1/055* (2013.01); *F02G 1/057* (2013.01); *F02G 1/06* (2013.01); *F01K 25/103* (2013.01); *F02G 1/043* (2013.01)

(58) Field of Classification Search
CPC ..... F02G 1/055; F02G 1/057; F02G 1/045; F02G 1/047; F02G 1/05; F02G 1/06; F01K 23/02; F01K 23/04; F01K 23/06; F01K 23/08; F01K 23/10; F01K 25/103
See application file for complete search history.

(56) References Cited

U.S. PATENT DOCUMENTS

| | | | |
|---|---|---|---|
| 3,777,718 | A | 12/1973 | Pattas |
| 4,026,114 | A | 5/1977 | Belaire |
| 4,030,297 | A | 6/1977 | Kantz et al. |
| 4,077,216 | A | 3/1978 | Cooke-Yarborough |
| 4,183,214 | A | 1/1980 | Beale et al. |
| 4,199,945 | A | 4/1980 | Finkelstein |
| 4,387,568 | A | 6/1983 | Dineen |
| 4,545,738 | A | 10/1985 | Young |
| 4,644,851 | A | 2/1987 | Young |
| 4,717,405 | A | 1/1988 | Budliger |
| 4,723,411 | A | 2/1988 | Darooka et al. |
| 7,134,279 | B2 | 11/2006 | White et al. |
| 8,720,198 | B2 | 5/2014 | Wood |
| 8,820,068 | B2 | 9/2014 | Dadd |
| 9,689,344 | B1 | 6/2017 | Gedeon |
| 2006/0059912 | A1 | 5/2006 | Romanelli et al. |
| 2019/0010834 | A1* | 1/2019 | Ford ..... F01K 7/32 |

OTHER PUBLICATIONS

Bin-Nun et al., Low Cost and High Performance Screen Laminate Regenerator Matrix, ScienceDirect, FLIR Systems, MA, vol. 44, Issues 6-8, Jun.-Aug. 2004, pp. 439-444. https://www.sciencedirect.com/science/article/abs/pii/S0011227504000700.

Bright Hub Engineering, Oil Piston Cooling, Oct. 19, 2009, 6 Pages. https://www.brighthubengineering.com/marine-engines-machinery/52783-how-are-marine-pistons-cooled-with-oil/.

Conner, 3D Printed Stirling Engine, Solar Heat Engines, Simulate, Analyze, Design, Build, and Test Solar-Powered Engines, Oct. 29, 2012, 12 Pages. http://www.solarheatengines.com/2012/10/29/3d-printed-stirling-engine/.

Conner, A Regenerator for the 3D Printed PE 2 Stirling Engine, Solar Heat Engines, Simulate, Analyze, Design, Build, and Test Solar-Powered Engines, Dec. 18, 2012, 9 Pages. http://www.solarheatengines.com/2012/12/18/a-regenerator-for-the-3d-printed-pe-2-stirling-engine/.

Deetlefs, Design, Simulation, Manufacture and Testing of a Free-Piston Stirling Engine, Thesis, Department of Mechatronic Engineering Stellenbosch University, Scholar Sun, South Africa, Dec. 2014, 138 Pages. https://scholar.sun.ac.za/bitstream/handle/10019.1/95922/deetlefs_design_2014.pdf?sequence=3&isAllowed=y.

Defense Visual Information Distribution Service (DVIDS), MOD II Automotive Stirling Engine, NASA, C-1986-3706, Washington, DC, 2 pages. https://www.dvidshub.net/image/844058/mod-ii-automotive-stirling-engine.

Defense Visual Information Distribution Service (DVIDS), MOD II Automotive Stirling Engine, NASA, C-1986-3724, Washington, DC, 2 pages. https://www.dvidshub.net/image/841262/mod-ii-automotive-stirling-engine.

Defense Visual Information Distribution Service (DVIDS), MOD II Automotive Stirling Engine, NASA, C-1986-3725, Washington, DC, 2 pages. https://www.dvidshub.net/image/759360/mod-ii-automotive-stirling-engine.

Devitt, Restriction and Compensation of Gas Bearings—Bently Bearings by Newway, Aston, PA, 5 Pages. https://bentlybearings.com/restriction-and-compensation/.

Dudareva et al., Thermal Protection of Internal Combustion Engines Pistols, Science Direct, Procedia Engineering, vol. 206, 2017, pp. 1382-1387. https://www.sciencedirect.com/science/article/pii/S1877705817353341.

Electropaedia, Battery and Energy Technologies, Energy Conversion and Heat Engines, Woodbank Communications Ltd., Chester, United Kingdom, 2005, 11 Pages. https://www.mpoweruk.com/heat_engines.htm.

Elizondo-Luna, Investigation of Porous Metals as Improved Efficiency Regenerators, The University of Sheffield, Doctor of Philosophy Thesis, Mar. 2016, 261 Pages. http://etheses.whiterose.ac.uk/13111/1/Thesis%20Elizondo-Luna.pdf.

Enerlyt Stirling Engine, Enerlyt, Glowing-Isothermal-Mechanical-Stirling-Arranged-Motor, Enerlyt Technik GmbH, Potsdam, 2012, 13 Pages. http://www.enerlyt.de/english/pdf/en_motorbeschreibung_040413.pdf.

Engine Piston, GIF Shared on GIPHY, 1 Page. https://giphy.com/gifs/engine-hybrid-piston-10YyqVUCHx2HC.

Fouzi, Chapter 6: Piston and Piston Rings, DJA3032 Internal Combustion Engine, Politeknik Malaysia, 201, 5 Pages. https://www.slideshare.net/mechanical86/dja3032-chapter-6.

Free-Piston Engine Range Extender Technology, Sir Joseph Swan Centre for Energy Research, 2016. (Video) https://www.youtube.com/watch?v=u4b0_6byuFU.

Garcia-Santamaria et al., A German Inverse Woodpile Structure with a Large Photonic Band Gap, Advanced Materials Communication, Wiley InterScience, 2007, Adv. Mater. 0000, 00, pp. 1-5. http://colloids.matse.illinois.edu/articles/garcia_advmat_2007.pdf.

General Electric—GE Power, Breaking the Power Plant Efficiency Record, 2016, 4 Pages. https://www.ge.com/power/about/insights/articles/2016/04/power-plant-efficiency-record.

Georgescu, Rotary Engine, 2007. (Video) https://www.youtube.com/watch?v=ckuQugFH68o.

Gibson, et al., Cellular Solids Structure and Properties, Cambridge University Press, 2nd Edition, 1997. (Web Link) https://doi.org/10.1017/CBO9781139878326.

Green Car Congress, New Toroidal Internal Combustion Engine Promises 20:1 Power-to-Weight-Ratio Energy, Technologies, Issues and Polices for Sustainable Mobility, Apr. 2006, 2 Pages. https://www.greencarcongress.com/2006/04/new_toroidal_in.html.

Hoegel et al., Theoretical Investigation of the Performance of an Alpha Stirling Engine for Low Temperature Applications, Conference: ISEC 15th International Stirling Engine Conference, ResearchGate, New Zealand, Jan. 2012, 10 Pages. https://www.researchgate.net/publication/256706755_Theoretical_investigation_of_the_performance_of_an_Alpha_Stirling_engine_for_low_temperature_applications.

Honeywell Aerospace, Ultra Long-Life, Flight Qualified Technology for High Speed Imaging and Sensing Infra-Red Detectors, Stirling Cycle Cryocoolers, Auxiliary Power and Thermal, Honeywell Aerospace, 3 Pages. https://aerospace.honeywell.com/en/products/auxiliary-power-and-thermal/stirling-cycle-cryocoolers.

Howden, Reciprocating Compressor C series—animation, Jun. 2017. (Video) https://www.youtube.com/watch?v=owNOdUBL37U&feature&youtu.be.

http://www.hybrid-engine-hope.com/media/pagini/95_0071d630dba777d16e9a770de27060e6.gif (Web Link).

(56) References Cited

OTHER PUBLICATIONS

Huang, Toroidal Engine Ver: 2.0, 2017. (Video) https://www.youtube.com/watch?v=n5L0Zc6Ic8Y&feature=youtu.be.
Ishikawa et al., Development of High Efficiency Gas Turbine Combined Cycle Power Plant, Power Systems Headquarters, Mitsubishi Heavy Industries, Ltd., Technical Review, vol. 45, No. 1, Mar. 2008, pp. 15-17. http://courses.me.metu.edu.tr/courses/me476/downloads/476s08ProjectPt4GtTemp.pdf.
Microgen Engine Corporation. Technology. (Web Link) https://www.microgen-engine.com/technology/technology/.
Murphy, IAV Sees Huge Potential With 3D-Printed Pistons, Wards Auto, Apr. 12, 2018, 6 Pages. https://www.wardsauto.com/engines/iav-sees-huge-potential-3d-printed-pistons.
Ni et al., Improved Simple Analytical Model and Experimental Study of a 100 W B-Type Stirling Engine, Applied Energy, vol. 169, 2016, pp. 768-787. https://www.researchgate.net/publication/296632477_Improved_Simple_Analytical_Model_and_experimental_study_of_a_100W_b-type_Stirling_engine/figures?lo=.
Nightingale, Automotive Stirling Engine, Mod II Design Report, DOE/NASA/0032-28, NASA CR-175106, TI86ASE58SRI, New York, 1986, 54 Pages. https://ntrs.nasa.gov/archive/nasa/casi.ntrs.nasa.gov/19880002196.pdf.
O'Dell, SuperTruck Program Scores Big, Head into Second 5-Year Phase, Trucking.com, 2016, 7 Pages. https://www.trucks.com/2016/10/31/supertruck-program-5-year-phase/.
Owczarek, On the Design of Lubricant Free Piston Compressors, Nonlinear Solid Mechanics, Faculty of Engineering Technology, Thesis, University of Twente, Enschede, Sep. 17, 2010. (Abstract Only) https://research.utwente.nl/en/publications/on-the-design-of-lubricant-free-piston-compressors.
Panesar et al., Strategies for Functionally Graded Lattice Structures Derived Using Topology Optimisation for Additive Manufacturing, ScienceDirect, Additive Manufacturing, vol. 19, Jan. 2018, pp. 81-94. https://doi.org/10.1016/j.addma.2017.11.008.
Park et al., Thermal/Fluid Characteristics of Isotropic Plain-Weave Screen Laminates as Heat Exchange Surfaces, AIAA 2002-0208, 2002, pp. 1-9 https://wolfweb.unr.edu/~rawirtz/Papers/AIAA2002-0208.pdf.
Penswick et al., Duplex Stirling Machines, Sunpower Incorporated 19th Annual Intersociety Energy Conversion Engineering Conference, QP051082-A, vol. 3, No. CONF-840804, United States, 1984, 7 Pages. https://www.ohio.edu/mechanical/stirling/engines/Duplex-Stirling-Machines.pdf.
Pneumatic Round Body Cylinder—SRG_SRG Series, Parker, Richland MI, 3 Pages. http://ph.parker.com/us/en/pneumatic-round-body-cylinder-srg-srgm-series.
Qiu et al., Advanced Stirling Power Generation System for CHP Application, ARPA, Temple University, Philadelphia, 5 Pages. https://arpa-e.energy.gov/sites/default/files/Temple_GENSETS_Kickoff.pdf.
Ranieri et al., Efficiency Reduction in Stirling Engines Resulting from Sinusoidal Motions, Energies, vol. 11, No. 11: 2887, 2018, 14 Pages. https://doi.org/10.3390/en11112887.
Renewable Energy, Double-Acting Stirling Engine, Stirling Engine, 1 Page. (Abstract Only) https://sites.google.com/a/emich.edu/cae546816t5/history/types/double-acting-stirling-engine.
Rodriguez Perez, Cellular Nanocomposites: A New Type of Light Weight Advanced Materials with Improved Properties, CellMat Technologies S.L. Transfer Center and Applied Technologies, Valladolid, 35 Pages. http://crono.ubu.es/innovationh2020/pdf/cellmat.pdf.
Schonek, How big are power line losses?, Energy Management/Energy Efficiency, Schneider Electric, Mar. 25, 2013, 2 Pages. https://blog.schneider-electric.com/energy-management-energy-efficiency/2013/03/25/how-big-are-power-line-losses.
Schwartz, The Natural Gas Heat Pump and Air Conditioner, 2014 Building Technologies Office Peer Review, ThermoLift, Inc., U.S. Department of Energy, Energy Efficiency & Renewable Energy, DE-FOA-0000823, 27 Pages (Refer to p. 7) https://www.energy.gov/sites/prod/files/2014/11/f19/BTO%202014%20Peer%20Review%20Presentation%20-%20ThermoLift%204.4.14.pdf.
Shimizu, Next Prius Will Have Engine Thermal Efficiency of 40%, XTECH, Solar Plant Business, Nikkei Business Publications, May 22, 2015, 2 Pages. https://tech.nikkeibp.co.jp/dm/english/NEWS_EN/20150522/419560/.
Stirling Engines, Solar Cell Central, 5 Pages. http://solarcellcentral.com/stirling_page.html.
Stirling Engines, Regenerators, What They Are and How They Work, American Stirling Company, 7 Pages. https://www.stirlingengine.com/regenerators/.
Technology, Microgen Engine Corporation, 2016, 4 Pages. https://www.microgen-engine.com/technology/technology/.
ThermoLift, Technology—Background, The Thermodynamic Process Behind ThermoLift, ThermoLift, Inc., 3 Pages. http://www.tm-lift.com/background/.
Thimsen, Stirling Engine Assessment, 1007317, Electronic Power Research Institute (EPRI), Palo Alto, California, 2002, 170 Pages. http://www.engr.colostate.edu/~marchese/mech337-10/epri.pdf.
Thomassen, Free Floating Piston Film (mpeg).mpg, Mar. 5, 2010. (Video) https://www.youtube.com/watch?v=bHFUi0F0PgA.
Toptica Photonics, 2-Photon Polymerization, FemtoFiber Technology for Two-Photon Polymerization, 2 Pages. https://www.toptica.com/applications/ultrafast-studies/2-photon-polymerization/.
Toyota Motor Corporation, Inline 4 Cylinder 2.5L Injection Gasoline Engine/New Transaxle, Global Website, Dec. 6, 2016, 2 Pages. https://global.toyota/en/download/14447877/.
Tuncer et al., Structure-Property Relationship in Titanium Foams, Anadolu University, Turkey, Feb. 2011, 35 Pages. https://ocw.mit.edu/courses/materials-science-and-engineering/3-054-cellular-solids-structure-properties-and-applications-spring-2015/lecture-notes/MIT3_054S15_L13_Cellular.pdf.
Urieli, Chapter 5B—Regenerator Simple Analysis, Ohio State University, Stirling Cycle Machine Analysis by Israel Urieli, Jan. 17, 2010, 5 Pages. https://www.ohio.edu/mechanical/stirling/simple/regen_simple.html.
Vodhanel, Characterization of Performance of a 3D Printed Stirling Engine Through Analysis and Test, Cleveland State University Engaged Scholarship@CSU, ETD Archive, 2016, 91 Pages. https://engagedscholarship.csuohio.edu/cgi/viewcontent.cgi?referer=https://www.google.com/&httpsredir=1&article=1944&context=etdarchive.
Wikipedia, Heat Engine, 8 Pages. https://en.wikipedia.org/wiki/Heat_engine.
Wikipedia, Regenerative Heat Exchanger, 3 Pages. https://en.wikipedia.org/wiki/Regenerative_heat_exchanger.
Wikipedia, Stirling Engine, 2019, 24 Pages. https://en.wikipedia.org/wiki/Stirling_engine.
Wirtz et al., High Performance Woven Mesh Heat Exchangers, Mechanical Engineering Department, University of Nevada, Reno, 2002, 8 Pages. https://apps.dtic.mil/dtic/tr/fulltext/u2/a408219.pdf.
Wirtz et al., Thermal/Fluid Characteristics of 3-D Woven Mesh Structures as Heat Exchanger Surfaces, IEEE Transactions on Components and Packaging Technologies, vol. 26, No. 1, Mar. 2003, pp. 40-47. https://pdfs.semanticscholar.org/dla3/b4ce0baa639cf349d25d1506c3fa6118dc3e.pdf.
Wu et al., Model-based Analysis and Simulation of Regenerative Heat Wheel, ScienceDirect, Energy and Buildings, vol. 38, No. 5, May 2006, pp. 502-514. http://citeseerx.ist.psu.edu/viewdoc/download?doi=10.1.1.616.3103&rep=rep1&type=pdf.
Xie et al., Investigation on the Performances of the Gas Driven Vuilleumier Heat Pump, International Refrigeration and Air Conditioning Conference, Purdue University, School of Mechanical Engineering, 2008, 7 Pages. https://docs.lib.purdue.edu/cgi/viewcontent.cgi?referer=https://www.google.com/&httpsredir=1&article=1935&context=iracc.

* cited by examiner

CLOSED CYCLE ENGINE WITH BOTTOMING-CYCLE SYSTEM

CROSS-REFERENCE TO RELATED APPLICATION

This application is a continuation of U.S. application Ser. No. 16/417,787, filed May 21, 2019 and entitled CLOSED CYCLE ENGINE WITH BOTTOMING-CYCLE SYSTEM.

FIELD

The present subject matter relates generally to closed cycle engines having one or more bottoming-cycle systems.

BACKGROUND

Power generation and distribution systems are challenged to provide improved power generation efficiency and/or lowered emissions. Furthermore, power generation and distribution systems are challenged to provide improved power output with lower transmission losses. Certain power generation and distribution systems are further challenged to improve sizing, portability, or power density generally while improving power generation efficiency, power output, and emissions.

Certain engine system arrangements, such as closed cycle engines, may offer some improved efficiency over other engine system arrangements. However, closed cycle engine arrangements, such as Stirling engines, are challenged to provide relatively larger power output or power density, or improved efficiency, relative to other engine arrangements. Closed cycle engines may suffer due to inefficient combustion, inefficient heat exchangers, inefficient mass transfer, heat losses to the environment, non-ideal behavior of the working fluid(s), imperfect seals, friction, pumping losses, and/or other inefficiencies and imperfections. As such, there is a need for improved closed cycle engines and system arrangements that may provide improved power output, improved power density, or further improved efficiency. Additionally, there is a need for an improved closed cycle engine that may be provided to improve power generation and power distribution systems.

Additionally, or alternatively, there is a general need for improved heat transfer devices, such as for heat engines, or as may be applied to power generation systems, distribution systems, propulsion systems, vehicle systems, or industrial or residential facilities.

Furthermore, there is a need for improved control system and methods for operating power generation systems as may include subsystems that collectively may provide improved power generation efficiency or reduced emissions.

BRIEF DESCRIPTION

Aspects and advantages of the invention will be set forth in part in the following description, or may be obvious from the description, or may be learned through practice of the invention.

In one aspect, a system is provided. For instance, the system can be an energy conversion and/or power generation system. The system includes a closed cycle engine defining a cold side. Further, the system includes a chiller loop having a bottoming-cycle loop. The system also includes a pump positioned along the bottoming-cycle loop and operable to move a working fluid along the bottoming-cycle loop. Further, the system includes a cold side heat exchanger positioned along the bottoming-cycle loop in fluid communication with the pump and positioned in a heat exchange relationship with the cold side of the closed cycle engine, wherein the working fluid exits the cold side heat exchanger at a first temperature and a first pressure. The system also includes a constant density heat exchanger positioned along the bottoming-cycle loop and downstream of the cold side heat exchanger, wherein the constant density heat exchanger is operable to hold a volume of the working fluid flowing therethrough at constant density during heat application via a heat source such that a temperature and a pressure of the volume of the working fluid is increased to a second temperature and a second pressure, wherein the second temperature is greater than the first temperature and the second pressure is greater than the first pressure. Moreover, the system includes an expansion device in fluid communication with the constant density heat exchanger, the expansion device operable to extract thermal energy from the working fluid to produce work. The system additionally includes a third heat exchanger positioned along the bottoming-cycle loop and having an inlet and an outlet, the inlet of the third heat exchanger in fluid communication with the expansion device and the outlet of the third heat exchanger in fluid communication with the pump, wherein the third heat exchanger is operable to decrease the working fluid to a third temperature that is less than the first temperature.

In some embodiments, the working fluid is a compressible working fluid.

In some embodiments, the constant density heat exchanger holds the volume of working fluid at substantially constant volume.

In some embodiments, the volume of working fluid held at constant density is held within a working chamber of the constant density heat exchanger, and wherein the working chamber of the constant density heat exchanger is operable to iteratively receive volumes of working fluid.

In some embodiments, at least one of the volumes of working fluid received within the working chamber is held at constant density within the heating chamber during heat application.

In some embodiments, each of the volumes of working fluid is held at constant density within the heating chamber during heat application.

In some embodiments, the closed cycle engine is a regenerative heat engine.

In some embodiments, the constant density heat exchanger is operable to superheat the working fluid held at constant density during heat application.

In some embodiments, the working fluid is a supercritical fluid.

In some embodiments, the supercritical fluid is a supercritical carbon dioxide.

In some embodiments, the system further includes a pump operable to move the working fluid through the bottoming-cycle loop.

In some embodiments, the constant density heat exchanger is positioned between the cold side heat exchanger and the expansion device along the bottoming-cycle loop.

In some embodiments, the system includes one or more pulse converters positioned downstream of the constant density heat exchanger and upstream of the expansion device, wherein the one or more pulse converters are operable to smooth a pulsed flow of the working fluid flowing downstream from the constant density heat exchanger to the expansion device.

In some embodiments, the system further includes one or more electric machines operatively coupled with the expansion device, the one or more electric machines operable to generate electrical power when the expansion device produces work.

In some embodiments, the constant density heat exchanger is one of a plurality of constant density heat exchangers positioned along the bottoming-cycle loop.

In some embodiments, the cold side heat exchanger is a constant density heat exchanger.

In some embodiments, the closed cycle engine defines a hot side. In such embodiments, the system further includes a heater loop positioned at least in part in a heat exchange relationship with the hot side of the closed cycle engine for recovering hot combustion gases therefrom, and wherein the heater loop has a heat recovery loop along which recovered hot combustion gases are movable, the heat recovery loop positioned at least in part in a heat exchange relationship with the constant density heat exchanger such that recovered hot combustion gases impart thermal energy to the working fluid held at constant density within the working chamber.

In another aspect, a method is provided. The method includes operating a closed cycle engine, the closed cycle engine defining a cold side. The method also includes flowing a working fluid through a bottoming-cycle loop positioned at least in part in a heat exchange relationship with the cold side of the closed cycle engine. The method also includes holding, via a constant density heat exchanger positioned along the bottoming-cycle loop, a volume of the working fluid flowing therethrough at constant density. Further, the method includes applying, via a heat source, heat to the volume of the working fluid held at constant density.

In some implementations, the heat source is combustion gases recovered from a hot side of the closed cycle engine.

In some implementations, during applying, via the heat source, heat to the volume of the working fluid held at constant density, a temperature and a pressure of the volume of the working fluid is increased.

In some implementations, the method further includes expanding, via an expansion device positioned along the bottoming-cycle loop and downstream of the constant density heat exchanger, the volume of working fluid heated at constant density.

In some implementations, the method further includes causing the volume of working fluid heated at constant density to flow out of the working chamber, wherein causing the volume of working fluid heated at constant density to flow out of the working chamber comprises moving an outlet flow control device positioned at an outlet of the working chamber to an open position.

In some implementations, the method further includes causing the volume of working fluid to flow into the working chamber, and wherein causing the volume of working fluid to flow into the working chamber comprises moving an inlet flow control device positioned at an inlet of the working chamber to an open position.

In some implementations, the closed cycle engine can be configured in any of the example manners described herein.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure including the best mode, directed to one of ordinary skill in the art, is set forth in the specification, which makes reference to the appended figures, in which.

Figure 1:
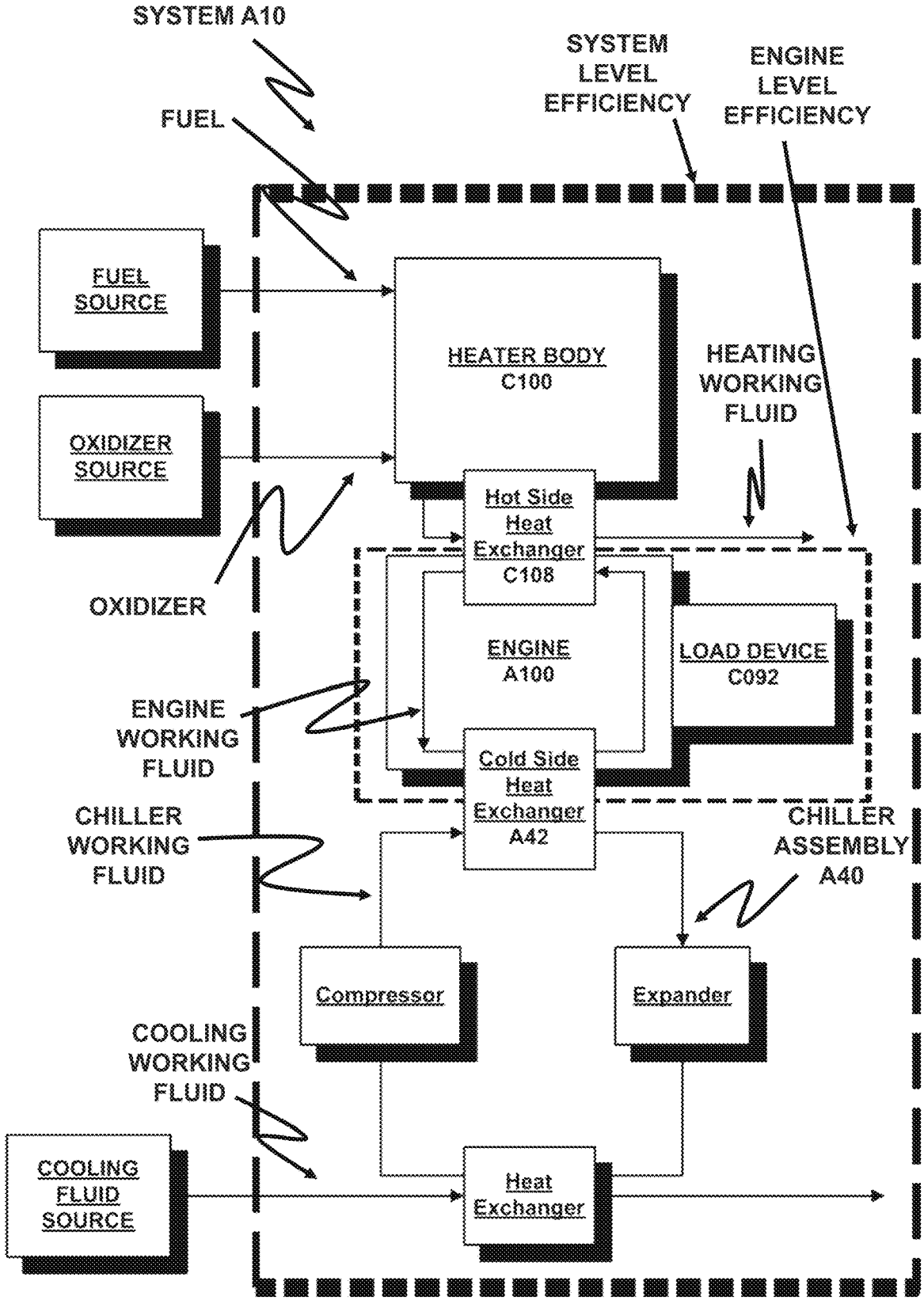
FIG. 1 is a schematic block diagram depicting a system for energy conversion according to an aspect of the present disclosure.

Repeat use of reference characters in the present specification and drawings is intended to represent the same or analogous features or elements of the present disclosure.

DETAILED DESCRIPTION

Reference now will be made in detail to embodiments of the disclosure, one or more examples of which are illustrated in the drawings. Each example is provided by way of explanation of the disclosure and not limitation. In fact, it will be apparent to those skilled in the art that various modifications and variations can be made in the present disclosure without departing from the scope of the disclosure. For instance, features illustrated or described as part of one embodiment can be used with another embodiment to yield a still further embodiment. In another instance, ranges, ratios, or limits associated herein may be altered to provide further embodiments, and all such embodiments are within the scope of the present disclosure. Unless otherwise specified, in various embodiments in which a unit is provided relative to a ratio, range, or limit, units may be altered, and/or subsequently, ranges, ratios, or limits associated thereto are within the scope of the present disclosure. Thus, it is intended that the present disclosure covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows. The term "loop" can be any suitable fluid pathway along which fluid can flow and can be either open or closed, unless stated otherwise.

Chapter 1—Generation, Conversion, and Distribution Systems

Power Generation, Engine and Energy Conversion Systems, and Energy Distribution Systems Improved power generation systems that provide improved efficiency and reduced emissions over known power generation systems that may further be sized or scaled to provide improved power distribution without adversely affecting efficiency and emissions are provided herein. The need for improved power generation systems is further, or alternatively, such that issues regarding power distribution, power generation versus changing peak power demands, emissions, barriers to infrastructure development, and challenges and limitations posed by vehicle electrification may each be addressed, improved upon, or alleviated.

Small-scale or portable power generation systems are desirable for applications including space vehicles and systems, automotive drivetrain and aerospace propulsion electrification, direct cooling sources, and portable or distributed power generation such as to address issues regarding power generation efficiency, density, and output. However, there is a need for improved thermal efficiency, electrical conversion efficiency, or both, for such systems.

Heat engines and other devices for converting thermal energy into useful work are generally inefficient relative to their maximum theoretical efficiency. Carnot's theorem states that the maximum theoretical efficiency ($\eta_{carnot}$) for an ideal, reversible heat engine is given by:

$$\eta_{Carnot} = 1 - \left(\frac{T_{Hot,engine}}{T_{Cold,ambient}}\right)$$

where $T_{hotengine}$ is the absolute temperature (e.g. in Rankine or Kelvin) at which heat enters the engine and $T_{cold,ambient}$ is the absolute temperature of the environment into which the engine exhausts its waste heat. $T_{Hot,engine}$ is generally limited by the maximum operating temperature of the materials in the engine and $T_{Cold,ambient}$ is limited by an available heat sink available (e.g., the atmosphere at ambient temperature, the temperature of a body of water, etc.). Closed cycle heat engines operate through an exchange of thermal energy to and from relatively hot and cold volumes of a piston engine. Closed cycle heat engines, such as Stirling arrangements, or variations thereof, such as Franchot or Vuilleimier arrangements, generally have a maximum theoretical efficiency that is the Carnot efficiency. As such, closed cycle engines such as Stirling arrangements are considered to have a greater potential as high efficiency engines based at least on the difference in maximum theoretical efficiency and actual efficiency.

Achieving maximum theoretical efficiency of a system is challenged or limited based at least on inefficient combustion, inefficient heat exchange, heat losses to a surrounding environment, non-ideal behavior of one or more working fluids, friction losses, pumping losses, or other inefficiencies and imperfections, or energy required to operate the system. Actual or real thermal efficiency $\eta_{th,system}$ of a system including a heat engine, heat generation sources, heat removal systems, or other heat exchangers, is given by:

$$\eta_{th,system} \equiv \frac{W_{out}}{Q_{in} + E_{in} + W_{in}} = \frac{(Q_{in} + E_{in} + W_{in}E_{in} + Q_{in} - \Sigma\ Q_{out})}{Q_{in} + E_{in} + W_{in}Q_{in}}$$

Actual or real thermal efficiency $\eta_{th}$ of a heat engine is given by:

$$\eta_{th} = \frac{W_{out}}{Q_{in}} = \frac{Q_{in} - Q_{out}}{Q_{in}} = 1 - \frac{Q_{out}}{Q_{in}}$$

where $W_{out}$ is the net useful work done by the engine, $Q_{in}$ is the thermal energy received by the engine, and $Q_{out}$ is the thermal energy lost or rejected to the environment. $E_{in}$ is the electrical energy used by the system for operation of the system (e.g., fuel and/or oxidizer pumps, cooling sources, etc.). $W_{in}$ is work input into the system. Achievable thermal efficiency tends to increase with power output. For example, motor vehicle applications are generally 20% to 35% thermally efficient, while large marine and stationary diesel systems can exceed 50% thermal efficiency. Stirling engines have demonstrated thermal efficiencies up to 38%.

The useful work generated by a heat engine can further be converted into electrical energy. The electrical efficiency ($\eta_{El}$) can be calculated in the same manner as the thermal efficiency:

$$\eta_{El} = \frac{E_{out}}{Q_{in}}$$

where $E_{out}$ is the net electrical energy output from an electric machine that is operatively coupled to the engine and $Q_{in}$ is the thermal energy received by the engine. $E_{out}$ may be calculated by subtracting any electricity required to operate the power generation system from the gross power generated by the system. If combustion is the source of heating working fluid for the engine, the electrical efficiency may be calculated using a lower heating value (LHV) of the fuel. Stirling engines have demonstrated LHV electrical efficiencies between 10% and 30%.

Closed cycle engines, such as Stirling arrangements, are challenged to produce increasing levels of power output and power density, and generally compromise improved efficiency or power output with larger sizes and scaling. Such larger sizes or scales can negate other desirable qualities of the engine, such as relatively small-scale or portability.

Stirling engines may generally include two types: kinematic or free piston. Kinematic Stirling engines use mechanically-connected piston assemblies to transmit and convert linear motion of the pistons to a rotary motion for an output shaft. Although such systems may address issues regarding power transmission and stability of the engine, mechanically-connected piston assemblies introduce relatively large power losses via the mechanical members. Additionally, or alternatively, the relatively fixed relationship of mechanically-connected piston assemblies limits the mechanical stroke of the piston assembly. As such, the efficiency of mechanically-connected multi-piston assemblies in a closed cycle engine is decreased in addition to mechanical losses (e.g., friction, leakage, inertia, etc.).

Single-piston free piston closed cycle engine arrangements generally exchange improved thermal efficiency for lower total power generation and density. As such, single-piston free piston closed cycle engine arrangements are not generally suited for higher power output applications.

Multi-piston free piston closed cycle engine arrangements may provide thermal efficiencies of single-piston free piston arrangements and further increase total power generation. However, multi-piston free piston arrangements generally differ from single-piston arrangements and mechanically-connected multi-piston arrangements in that the cycle or motion of a multi-piston free piston arrangement is generally determined by thermo-mechanical interactions of the entire system including the free pistons, the thermal source(s), and a power extraction apparatus. The thermo-mechanical interactions may further include mechanical losses and their effect on balance of the entire system.

For example, multi-piston free-piston closed cycle engines are challenged to respond to time lags. As another example, if one piston assembly drifts from an intended position a subsequent oscillation can become unbalanced. An unbalanced arrangement may lead to undesired vibrations, crashing of the pistons to end walls, or other mechanical losses that may further reduce power output, induce wear and deterioration, or otherwise reduce efficient, stable, or effective use of a multi-piston free piston engine.

As such, there is a need for improved closed cycle engines such as Stirling engines that provide improved power generation efficiency and output. Additionally, there is a need for such improved energy conversion or power generation systems that may further retain or improve power density, such as to provide relatively small-scale or portability such as to provide improved application to power generation and distribution systems.

System for Energy Conversion

Referring now to FIG. 1, an exemplary schematic block diagram depicting a system for energy conversion (hereinafter, "system A10") is provided. Various embodiments of the system A10 provided herein include systems for power generation, a heat recovery system, a heat pump or cryogenic cooler, a system including and/or acting as a bottoming cycle and/or a topping cycle, or other system for producing useful work or energy, or combinations thereof. Referring additionally for FIG. 2, various embodiments of the system A10 include a closed cycle engine apparatus (hereinafter, "engine A100", apparatus "A100", or "engine assembly C900", or otherwise denoted herein) operably coupled to a load device c092. The engine A100 contains a substantially fixed mass of an engine working fluid to which and from which thermal energy is exchanged at a respective cold side heat exchanger A42 and a hot side heat exchanger C108. In one embodiment, the engine working fluid is helium. In other embodiments, the engine working fluid may include air, nitrogen, hydrogen, helium, or any appropriate compressible fluid, or combinations thereof. In still various embodiments, any suitable engine working fluid may be utilized in accordance with the present disclosure. In exemplary embodiments, the engine working fluid may include a gas, such as an inert gas. For example, a noble gas, such as helium may be utilized as the engine working fluid. Exemplary working fluids preferably are inert, such that they generally do not participate in chemical reactions such as oxidation within the environment of the engine. Exemplary noble gasses include monoatomic gases such as helium, neon, argon, krypton, or xenon, as well as combinations of these. In some embodiments, the engine working fluid may include air, oxygen, nitrogen, or carbon dioxide, as well as combinations of these. In still various embodiments, the engine working fluid may be liquid fluids of one or more elements described herein, or combinations thereof. It should further be appreciated that various embodiments of the engine working fluid may include particles or other substances as appropriate for the engine working fluid.

In various embodiments, the load device C092 is a mechanical work device or an electric machine. In one embodiment, the load device C092 is a pump, compressor, or other work device. In another embodiment, the load device C092 as an electric machine is configured as a generator producing electric energy from movement of a piston assembly A1010 at the engine. In still another embodiment, the electric machine is configured as a motor providing motive force to move or actuate the piston assembly A1010, such as to provide initial movement (e.g., a starter motor). In still various embodiments, the electric machine defines a motor and generator or other electric machine apparatus such as described further herein.

A heater body C100 is thermally coupled to the engine A100. The heater body C100 may generally define any apparatus for producing or otherwise providing a heating working fluid such as to provide thermal energy to the engine working fluid. Various embodiments of the heater body C100 are further provided herein. Exemplary heater bodies C100 may include, but are not limited to, a combustion or detonation assembly, an electric heater, a nuclear energy source, a renewable energy source such as solar power, a fuel cell, a heat recovery system, or as a bottoming cycle to another system. Exemplary heater bodies C100 at which a heat recovery system may be defined include, but are not limited to, industrial waste heat generally, gas or steam turbine waste heat, nuclear waste heat, geothermal energy, decomposition of agricultural or animal waste, molten earth or metal or steel mill gases, industrial drying systems generally or kilns, or fuel cells. The exemplary heater body C100 providing thermal energy to the engine working fluid may include all or part of a combined heat and power cycle, or cogeneration system, or power generation system generally.

In still various embodiments, the heater body C100 is configured to provide thermal energy to the engine working fluid via a heating working fluid. The heating working fluid may be based, at least in part, on heat and liquid, gaseous, or other fluid provided by one or more fuel sources and oxidizer sources providing a fuel and oxidizer. In various embodiments, the fuel includes, but is not limited to, hydrocarbons and hydrocarbon mixtures generally, "wet" gases including a portion of liquid (e.g., humid gas saturated with liquid vapor, multiphase flow with approximately 10% liquid and approximately 90% gas, natural gas mixed with oil, or other liquid and gas combinations, etc.), petroleum or oil (e.g., Arabian Extra Light Crude Oil, Arabian Super Light, Light Crude Oil, Medium Crude Oil, Heavy Crude Oil, Heavy Fuel Oil, etc.), natural gas (e.g., including sour gas), biodiesel condensate or natural gas liquids (e.g., including liquid natural gas (LNG)), dimethyl ether (DME), distillate oil #2 (DO2), ethane ($C_2$), methane, high $H_2$ fuels, fuels including hydrogen blends (e.g., propane, butane, liquefied petroleum gas, naphtha, etc.), diesel, kerosene (e.g., jet fuel, such as, but not limited to, Jet A, Jet A-1, JP1, etc.), alcohols (e.g., methanol, ethanol, etc.), synthesis gas, coke over gas, landfill gases, etc., or combinations thereof.

In various embodiments, the system A10 includes a working fluid body C108, such as further described herein. In one embodiment, the working fluid body C108 defines a hot side heat exchanger A160, such as further described herein, from which thermal energy is output to the engine working fluid at an expansion chamber A221 of the engine. The working fluid body C108 is positioned at the expansion chamber A221 of the engine in thermal communication with the heater body C100. In other embodiments, the working fluid body C108 may be separate from the heater body C100, such that the heating working fluid is provided in thermal communication, or additionally, in fluid communication with the working fluid body C108. In particular embodiments, the working fluid body C108 is positioned in direct thermal communication with the heater body C100 and the expansion chamber A221 of the engine A100 such as to receive thermal energy from the heater body C100 and provide thermal energy to the engine working fluid within the engine.

In still various embodiments, the heater body C100 may include a single thermal energy output source to a single expansion chamber A221 of the engine. As such, the system A10 may include a plurality of heater assemblies each providing thermal energy to the engine working fluid at each expansion chamber A221. In other embodiments, such as depicted in regard to FIG. 2, the heater body C100 may provide thermal energy to a plurality of expansion chambers A221 of the engine. In still other embodiments, such as depicted in regard to FIG. 8, the heater body includes a single thermal energy output source to all expansion chambers A221 of the engine.

The system A10 further includes a chiller assembly, such as chiller assembly A40 further described herein. The chiller assembly A40 is configured to receive and displace thermal energy from a compression chamber A222 of the engine. The system A10 includes a cold side heat exchanger A42 thermally coupled to the compression chamber A222 of the closed cycle engine and the chiller assembly. In one embodiment, the cold side heat exchanger A42 and the piston body C700 defining the compression chamber A222 of the engine are together defined as an integral, unitary structure. In still various embodiments, the cold side heat exchanger A42, at least a portion of the piston body C700 defining the compression chamber A222, and at least a portion of the chiller assembly together define an integral, unitary structure.

In various embodiments, the chiller assembly A40 is a bottoming cycle to the engine A100. As such, the chiller assembly A40 is configured to receive thermal energy from the engine A100. The thermal energy received at the chiller assembly A40, such as through a cold side heat exchanger A42, or cold side heat exchanger A170 further herein, from the engine A100 is added to a chiller working fluid at the chiller assembly A40. In various embodiments, the chiller assembly A40 defines a Rankine cycle system through which the chiller working fluid flows in closed loop arrangement with a compressor. In some embodiments, the chiller working fluid is further in closed loop arrangement with an expander. In still various embodiments, the system A10 includes a heat exchanger A88 (FIG. 3). In various embodiments, the heat exchanger A188 may include a condenser or radiator. The cold side heat exchanger A40 is positioned downstream of the compressor and upstream of the expander and in thermal communication with a compression chamber A222 of the closed cycle engine, such as further depicted and described in regard to FIGS. 2-3. In various embodiments, the cold side heat exchanger A42 may generally define an evaporator receiving thermal energy from the engine A40.

Referring still to FIG. 1, in some embodiments, the heat exchanger A188 is positioned downstream of the expander and upstream of the compressor and in thermal communication with a cooling working fluid. In the schematic block diagram provided in FIG. 1, the cooling working fluid is an air source. However, in various embodiments, the cooling fluid may define any suitable fluid in thermal communication with the heat exchanger. The heat exchanger may further define a radiator configured to emit or dispense thermal energy from the chiller assembly A40. A flow of cooling working fluid from a cooling fluid source is provided in thermal communication with the heat exchanger to further aid heat transfer from the chiller working fluid within the chiller assembly A40 to the cooling working fluid.

As further described herein, in various embodiments the chiller assembly A40 may include a substantially constant density heat exchanger. The constant density heat exchanger generally includes a chamber including an inlet and an outlet each configured to contain or trap a portion of the chiller working fluid for a period of time as heat from the closed cycle engine is transferred to the cold side heat exchanger A42. In various embodiments, the chamber may define a linear or rotary chamber at which the inlet and the outlet are periodically opened and closed via valves or ports such as to trap the chiller working fluid within the chamber for the desired amount of time. In still various embodiments, the rate at which the inlet and the outlet of the chamber defining the constant density heat exchanger is a function at least of velocity of a particle of fluid trapped within the chamber between the inlet and the outlet. The chiller assembly A40 including the constant density heat exchanger may provide efficiencies, or efficiency increases, performances, power densities, etc. at the system A10 such as further described herein.

It should be appreciated that in other embodiments, the chiller assembly A40 of the system A10 may include a thermal energy sink generally. For example, the chiller assembly A40 may include a body of water, the vacuum of space, ambient air, liquid metal, inert gas, etc. In still various embodiments, the chiller working fluid at the chiller assembly A40 may include, but is not limited to, compressed air, water or water-based solutions, oil or oil-based solutions, or refrigerants, including, but not limited to, class 1, class 2, or class 3 refrigerants. Further exemplary refrigerants may include, but are not limited to, a supercritical fluid including, but not limited to, carbon dioxide, water, methane, ethane, propane, ethylene, propylene, methanol, ethanol, acetone, or nitrous oxide, or combinations thereof. Still exemplary refrigerants may include, but are not limited to, halon, perchloroolefin, perchlorocarbon, perfluoroolefin, perfluorocarbon, hydroolefin, hydrocarbon, hydrochloroolefin, hydrochlorocarbon, hydrofluoroolefin, hydrofluorocarbon, hydrochloroolefin, hydrochlorofluorocarbon, chlorofluoroolefin, or chlorofluorocarbon type refrigerants, or combinations thereof. Still further exemplary embodiments of refrigerant may include, but are not limited to, methylamine, ethylamine, hydrogen, helium, ammonia, water, neon, nitrogen, air, oxygen, argon, sulfur dioxide, carbon dioxide, nitrous oxide, or krypton, or combinations thereof.

It should be appreciated that where combustible or flammable refrigerants are included for the chiller working fluid, various embodiments of the system A10 may beneficially couple the heater body C100, and/or the fuel source, and the chiller assembly A40 in fluid communication such that the combustible or flammable working fluid to which thermal energy is provided at the chiller assembly A40 may further be utilized as the fuel source for generating heating working fluid, and the thermal energy therewith, to output from the heater body C100 to the engine working fluid at the engine A100.

Energy Conversion Apparatus

Figure 2:
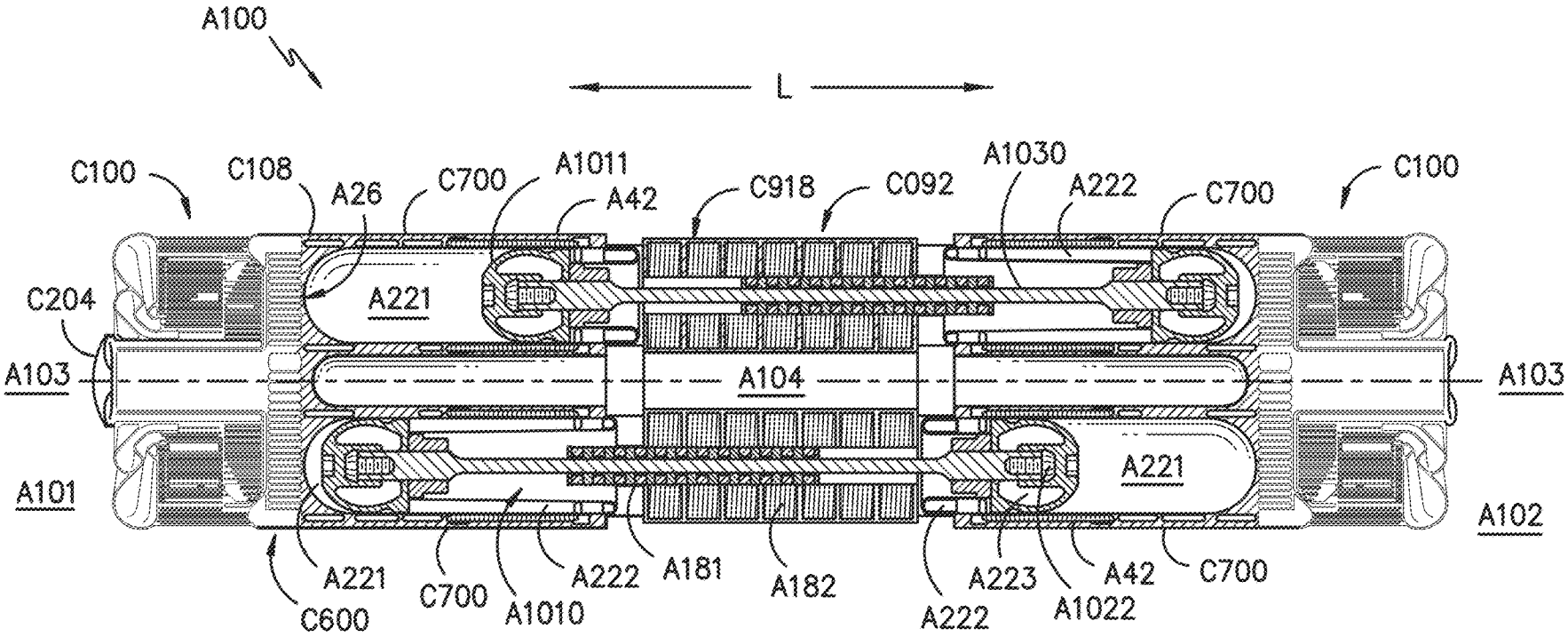
FIG. 2 is a cross sectional view of an exemplary embodiment of a closed cycle engine and load device according to an aspect of the present disclosure.
Figure 3:
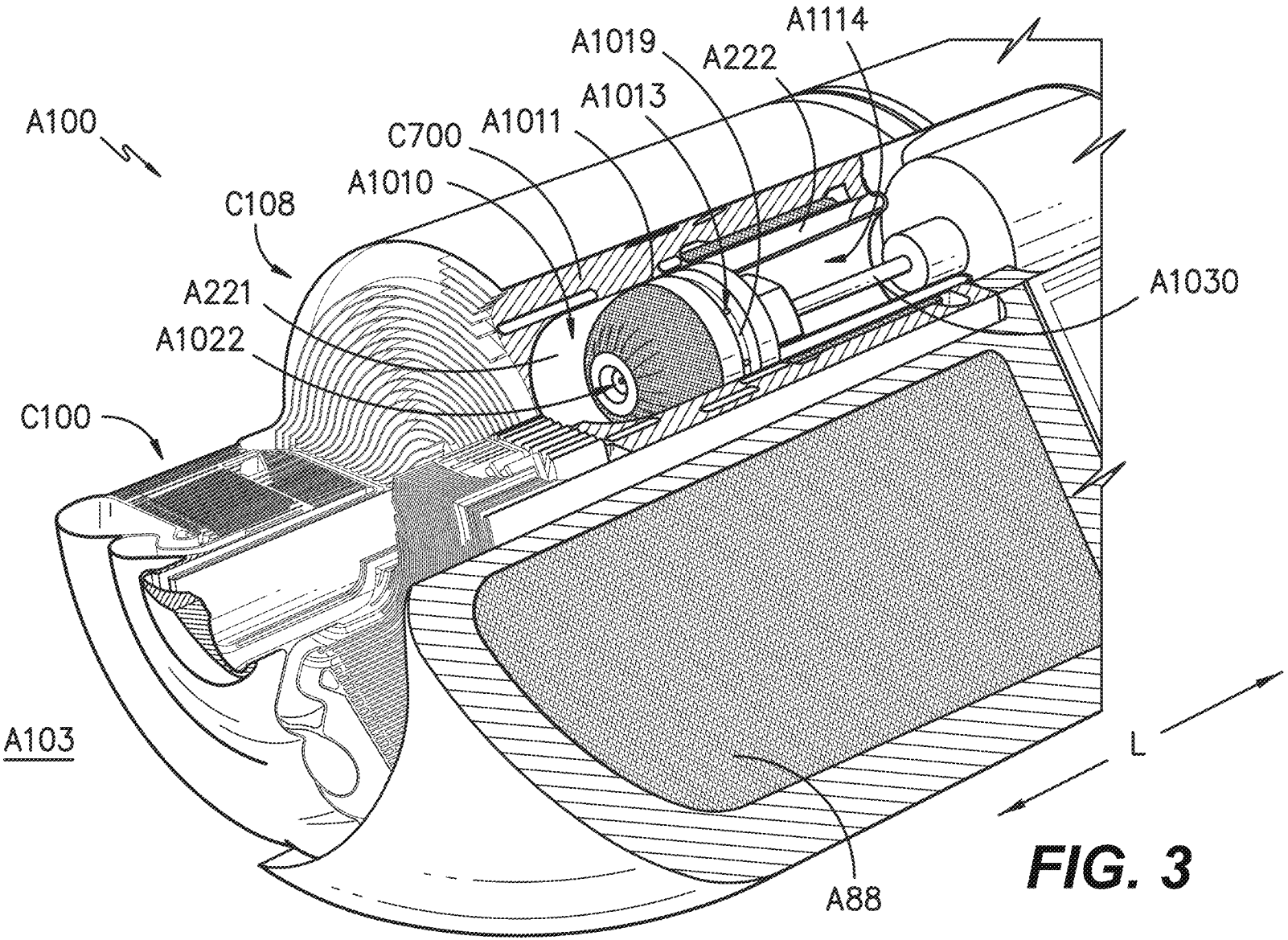
FIG. 3 is a perspective cutaway view of an exemplary portion of an exemplary embodiment of an engine according to an aspect of the present disclosure.

Referring now to FIGS. 2-3, exemplary embodiments of the system A10 are further provided. FIG. 2 is an exemplary cross sectional view of the system A10 including the heater body C100 and the chiller assembly A40 each in thermal communication with the engine A100, or particularly the engine working fluid within the engine A100, such as shown and described according to the schematic block diagram of FIG. 1. FIG. 3 is an exemplary cutaway perspective view of a portion of the engine A100. The system A10 includes a closed cycle engine A100 including a piston assembly A1010 positioned within a volume or piston chamber defined by a wall defining a piston body C700. The volume within the piston body C700 is separated into a first chamber, or hot chamber, or expansion chamber A221 and a second chamber, or cold chamber (relative to the hot chamber), or compression chamber A222 by a piston A1011 of the piston assembly A1010. The expansion chamber A221 is positioned thermally proximal to the heater body C100 relative to the compression chamber A222 thermally distal to the heater body C100. The compression chamber A222 is positioned thermally proximal to the chiller assembly A40 relative to the expansion chamber A221 thermally distal to the chiller assembly A40.

In various embodiments, the piston assembly A1010 defines a double-ended piston assembly A1010 in which a pair of pistons A1011 is each coupled to a connection member A1030. The connection member A1030 may generally define a rigid shaft or rod extended along a direction of motion of the piston assembly A1010. In other embodiments, the connection members A1030 includes one or more springs or spring assemblies, such as further provided herein, providing flexible or non-rigid movement of the connection member A1030. In still other embodiments, the connection member A1030 may further define substantially U- or V-connections between the pair of pistons A1011.

Each piston A1011 is positioned within the piston body C700 such as to define the expansion chamber A221 and the compression chamber A222 within the volume of the piston body C700. The load device c092 is operably coupled to the piston assembly A1010 such as to extract energy therefrom, provide energy thereto, or both. The load device c092 defining an electric machine is in magnetic communication with the closed cycle engine via the connection member A1030. In various embodiments, the piston assembly A1010 includes a dynamic member A181 positioned in operable communication with a stator assembly A182 of the electric machine. The stator assembly A182 may generally include a plurality of windings wrapped circumferentially relative to the piston assembly A1010 and extended along a lateral direction L. In one embodiment, such as depicted in regard to FIG. 2, the dynamic member A181 is connected to the connection member A1030. The electric machine may further be positioned between the pair of pistons A1011 of each piston assembly A1010. Dynamic motion of the piston assembly A1010 generates electricity at the electric machine. For example, linear motion of the dynamic member A181 between each pair of chambers defined by each piston A1011 of the piston assembly A1010 generates electricity via the magnetic communication with the stator assembly A182 surrounding the dynamic member A181.

Referring to FIG. 2-FIG. 3, in various embodiments, the working fluid body C108 may further define at least a portion of the expansion chamber A221. In one embodiment, such as further described herein, the working fluid body C108 defines a unitary or monolithic structure with at least a portion of the piston body C700, such as to define at least a portion of the expansion chamber A221. In some embodiments, the heater body C100 further defines at least a portion of the working fluid body C108, such as to define a unitary or monolithic structure with the working fluid body C108, such as further described herein. In one embodiment, the system A10 includes the hot side heat exchanger or working fluid body C108 positioned between the heater body C100 and the expansion chamber A221 of the piston body C700. In various embodiments, the working fluid body C108 includes a plurality of heater conduits or working fluid pathways extended from the expansion chamber A221.

The engine A100 defines an outer end A103 and an inner end A104 each relative to a lateral direction L. The outer ends A103 define laterally distal ends of the engine A100 and the inner ends 104 define laterally inward or central positions of the engine A100. In one embodiment, such as depicted in regard to FIG. 2-FIG. 3, the heater body C100 is positioned at outer ends A103 of the system A10. The piston body C700 includes a dome structure A26 at the expansion chamber A221. The expansion chamber dome structure A26*s* provides reduced surface area heat losses across the outer end A103 of the expansion chamber A221. In various embodiments, the pistons A1011 of the piston assembly A1010 further include domed pistons A1011 corresponding to the expansion chamber A221 dome. The dome structure A26, the domed piston A1011, or both may provide higher compressions ratios at the chambers A221, A222, such as to improve power density and output.

The chiller assembly A40 is positioned in thermal communication with each compression chamber A222. Referring to FIG. 2-FIG. 3, the chiller assembly A40 is positioned inward along the lateral direction L relative to the heater body C100. In one embodiment, the chiller assembly A40 is positioned laterally between the heater body C100 and the load device c092 along the lateral direction L. The chiller assembly A40 provides the chiller working fluid in thermal communication with the engine working fluid at the cold side heat exchanger A42 and/or compression chamber A222. In various embodiments, the piston body C700 defines the cold side heat exchanger A42 between an inner volume wall A46 and an outer volume wall A48 surrounding at least the compression chamber A222 portion of the piston body C700.

In various embodiments, such as depicted in regard to FIG. 2-FIG. 3, the load device c092 is positioned at the inner end A104 of the system A10 between laterally opposing pistons A1011. The load device c092 may further include a machine body c918 positioned laterally between the piston bodies C700. The machine body c918 surrounds and houses the stator assembly A182 of the load device c092 defining the electric machine. The machine body c918 further surrounds the dynamic member A181 of the electric machine attached to the connection member A1030 of the piston assembly A1010. In various embodiments, such as depicted in regard to FIG. 2-FIG. 3, the machine body c918 further provides an inner end wall A50 at the compression chamber A222 laterally distal relative to the expansion chamber A221 dome.

Engine Chamber to Chamber Conduits Arrangements

Referring to FIGS. 4 through 7, side, end, and perspective views of a portion of the system A10 are provided. The embodiments provided in regard to FIGS. 4 through 7 are configured substantially similarly as shown and described in regard to FIG. 2-FIG. 3. In regard to FIGS. 4-7, the portions of the system A10 depicted therein include four piston assemblies A1010 positioned within eight respective piston bodies C700. The piston bodies C700 may generally include the first volume wall and the second volume wall shown and described in regard to FIGS. 2-3. The piston bodies C700 may generally define cylinders into which pistons A1011 of the piston assembly A1010 are each positioned such as to define the expansion chamber A221 and the compression chamber A222 within each piston body C700. However, it should be appreciated that other suitable geometries of the piston body C700 containing the piston A1011 may be utilized.

The engine A100 further includes a plurality of walled conduits A1050 connecting particular chambers A221, A222 of each piston body C700 (FIG. 2) such as to define a balanced pressure arrangement of the pistons A1011. In various embodiments, the engine A100 includes at least one interconnected volume of chambers A221, A222 such as described herein. In one embodiment, such as depicted in regard to FIGS. 4-7, the engine A100 includes two interconnected volumes in which each interconnected volume includes an expansion chamber A221 of a first piston body C700 of a first piston assembly A1010 connected in fluid communication of the engine working fluid with a compression chamber A222 of a second piston body C700 of a second piston assembly A1010 each connected by a conduit A1050. More particularly, the balanced pressure arrangement of piston assemblies A1010 depicted in regard to FIGS. 4-7 includes two interconnected volumes each substantially fluidly separated from one another and/or substantially pneumatically separated from one another. The fluidly separated and/or pneumatically separated arrangement of chambers A221, A222 into the interconnected volume, and those chambers A221, A222 outside of the interconnected volume or in another interconnected volume, is particularly provided via the arrangement of expansion chambers A221 connected to compression chambers A222 via the walled conduits A1050 such as further described herein.

In various embodiments, the interconnected volume includes pairs of the expansion chamber A221 fluidly coupled to the compression chamber A222 each defined at laterally separated ends of the piston assemblies A1010. In one embodiment, the engine A100 defines a first end 101 separated along the lateral direction L by the connection member A1030 from a second end 102, such as depicted in FIG. 5 and FIG. 6. Each end of the engine A100 defines an expansion chamber A221 and a compression chamber A222 at each piston A1011 of each piston assembly A1010. The engine A100 depicted in FIGS. 4-7, and further in regard to FIG. 2, includes the expansion chamber A221 at one end connected to a respective compression chamber A222 at another end via respective conduits. In one embodiment, such as depicted in FIGS. 5 and 6, the engine A100 includes two expansion chambers A221 at the first end 101 each connected to respective compression chambers A222 at the second end 102 via respective conduits A1050. The engine A100 further includes two expansion chambers A221 at the second end 102 each connected to respective compression chamber A222 at the first end 101 via respective conduits A1050. The system A10 further includes four expansion chambers A221 at one end each connected to respective compression chambers A222 at the same end via respective conduits A1050. In one embodiment, the system A10 includes two expansion chambers A221 at the first end 101 each connected to respective compression chambers A222 at the first end 101 via respective walled conduits A1050. The system A10 further includes two expansion chambers A221 at the second end 102 each connected to respective compression chambers A222 at the second end 102 via respective walled conduits A1050.

In one embodiment, the engine includes four piston assemblies A1010 extended along the lateral direction L and in circumferential arrangement relative to the reference longitudinal axis C204. The piston assemblies A1010 may be positioned equidistant to one another around the reference longitudinal axis C204. In one embodiment, a pair of the heater body is positioned at outer ends A103 of the engine. The heater body is positioned proximate to the expansion chamber A221 and distal to the compression chamber A222. Each heater body may be positioned and configured to provide a substantially even flow of thermal energy to four hot side heat exchangers 160 or expansion chambers A221 at a time.

In other embodiments, the engine A100 includes two or more piston assemblies A1010 in side-by-side arrangement. The piston assemblies A1010 may be positioned equidistant relative to one another. In still various embodiments, a single heater body C100 may be positioned relative to each hot side heat exchanger or working fluid body C108. It should be appreciated that various embodiments of the system A10 provided herein may include any quantity of heater bodies positioned at any quantity of expansion chambers A221 as desired. Further embodiments of the system A10 provided herein in regard to FIGS. 8 through 11 further illustrate positioning of the heater body C100 relative to the expansion chamber A221. However, it should be appreciated that other arrangements may be utilized as desired such as to provide thermal energy to the expansion chambers A221. In still various embodiments, other arrangements may be utilized such as to provide selective or independent operability of a plurality of heater bodies C100. For example, selective or independent operability of the plurality of heater bodies C100 may desirably control a temperature, flow rate, or other property of thermal energy, or particularly the heating working fluid, provided in thermal communication to the working fluid body C108. Selective operability may further include selective on/off operation of one or more heater bodies C100 independent of one another.

It should further be appreciated that although the piston assemblies A1010 of the engine A100 are depicted in straight, flat, inline, or horizontally opposed arrangements, the piston assemblies A1010 and heater bodies C100 may alternatively be arranged in V-, W-, radial, or circumferential arrangements, or other suitable piston assembly A1010 arrangements. For example, one or more embodiments of the system A10 may include a center and/or outer heater body C100 around which the plurality of piston assemblies A1010 is positioned.

Referring now to FIGS. 8 through 11, further exemplary embodiments of the system A10 are provided. The embodiments provided in regard to FIGS. 8 through 11 are configured substantially similarly as shown and described in regard to FIGS. 1 through 5. Referring to FIGS. 8 through 11, positioning the load device c092 outside of the inner ends 104 of the piston assembly A1010 provides the connection member A1030 to be shorter between pistons A1011. The shorter connection member A1030 provides the pistons A1011 to be positioned more closely together in contrast to a longer connection member A1030 based at least on the load device c092 being positioned at the inner ends 104 of the piston assembly A1010. In regard to FIG. 8, the load device c092 is formed at least in part by the piston A1011 and the surrounding piston body C700. In regard to FIGS. 9-10, the load device c092 is positioned at one or more outer ends A103 of the engine. Positioning the load device c092 outside of the inner ends 104 provides dimensions and sizing of the load device c092 to be substantially de-coupled from dimensions and sizing of the closed cycle engine. For example, positioning the load device c092 outside of the inner end A104 of the engine de-couples the length and thickness of the dynamic member A181 from the connection member A1030. As another example, positioning the load device c092 outside of the inner end A104 of the engine de-couples a desired power density of the engine from the sizing and dimensions of the load device c092, such as an electric machine. As such, the shorter connection member A1030 between the pistons A1011 provides a smaller packaging of the engine while substantially maintaining the power generation and output relative to other arrangements.

Figure 8:
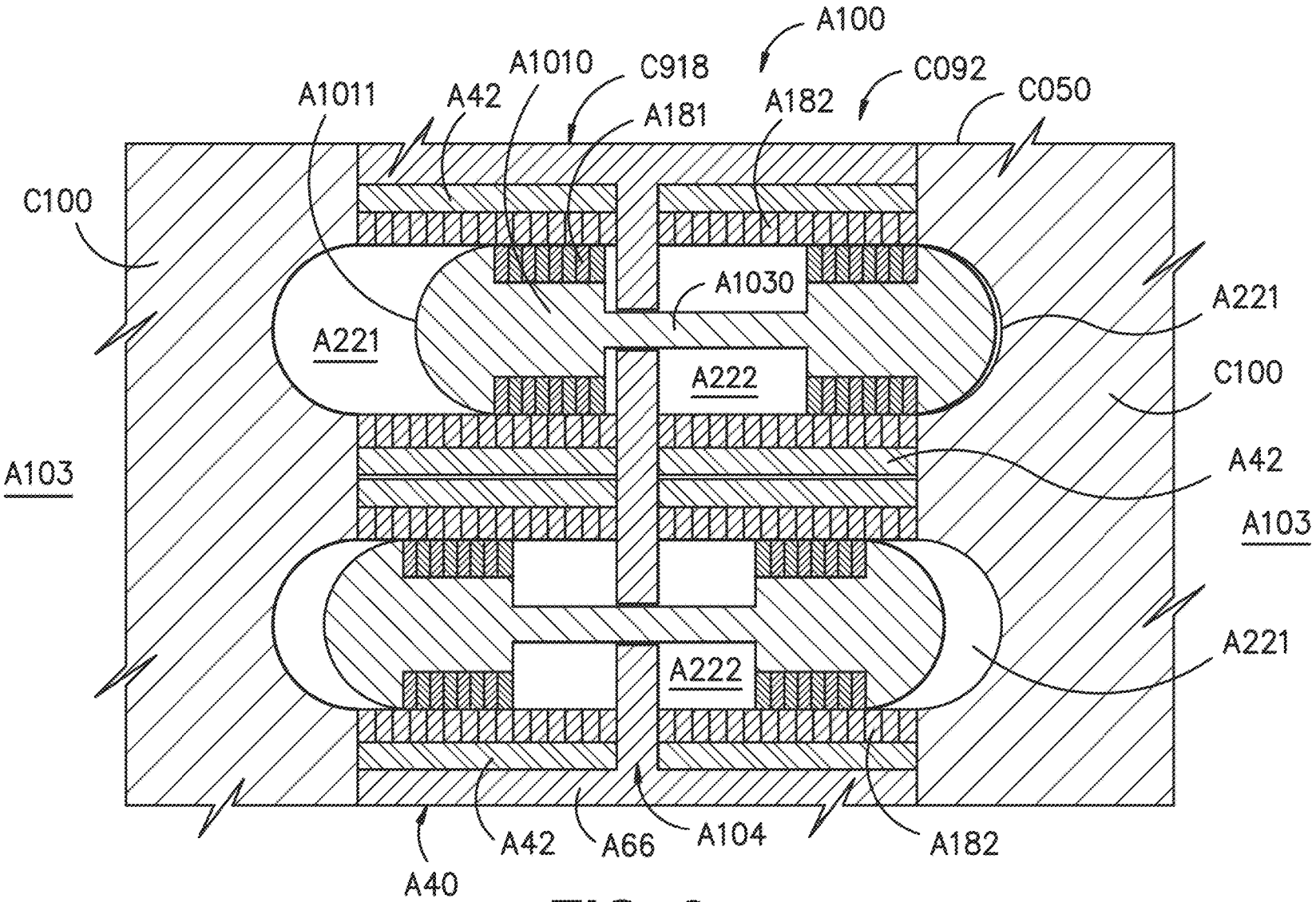
FIG. 8 is a schematic view of an embodiment of an arrangement of a portion of a system including an engine and a load device according to an aspect of the present disclosure.

In FIG. 8, the dynamic member A181 of the load device c092 defining the electric machine is positioned at the pistons A1011 of the piston assembly A1010. The stator assembly A182 of the electric machine is positioned at the piston body C700, such as at the second volume wall. Lateral movement of the pistons A1011 relative to the surrounding stator assembly A182 at the piston body C700 generates electricity at the electric machine. The system A10 further includes the chiller assembly surrounding the electric machine. In more particular embodiments, the chiller assembly surrounds the stator assembly A182 of the load device c092 defining an electric machine. The chiller assembly may further provide working fluid in thermal communication with inner ends 104 of the system A10, such as to provide thermal communication to the compression chamber A222 via the inner end wall A50.

Figure 9:
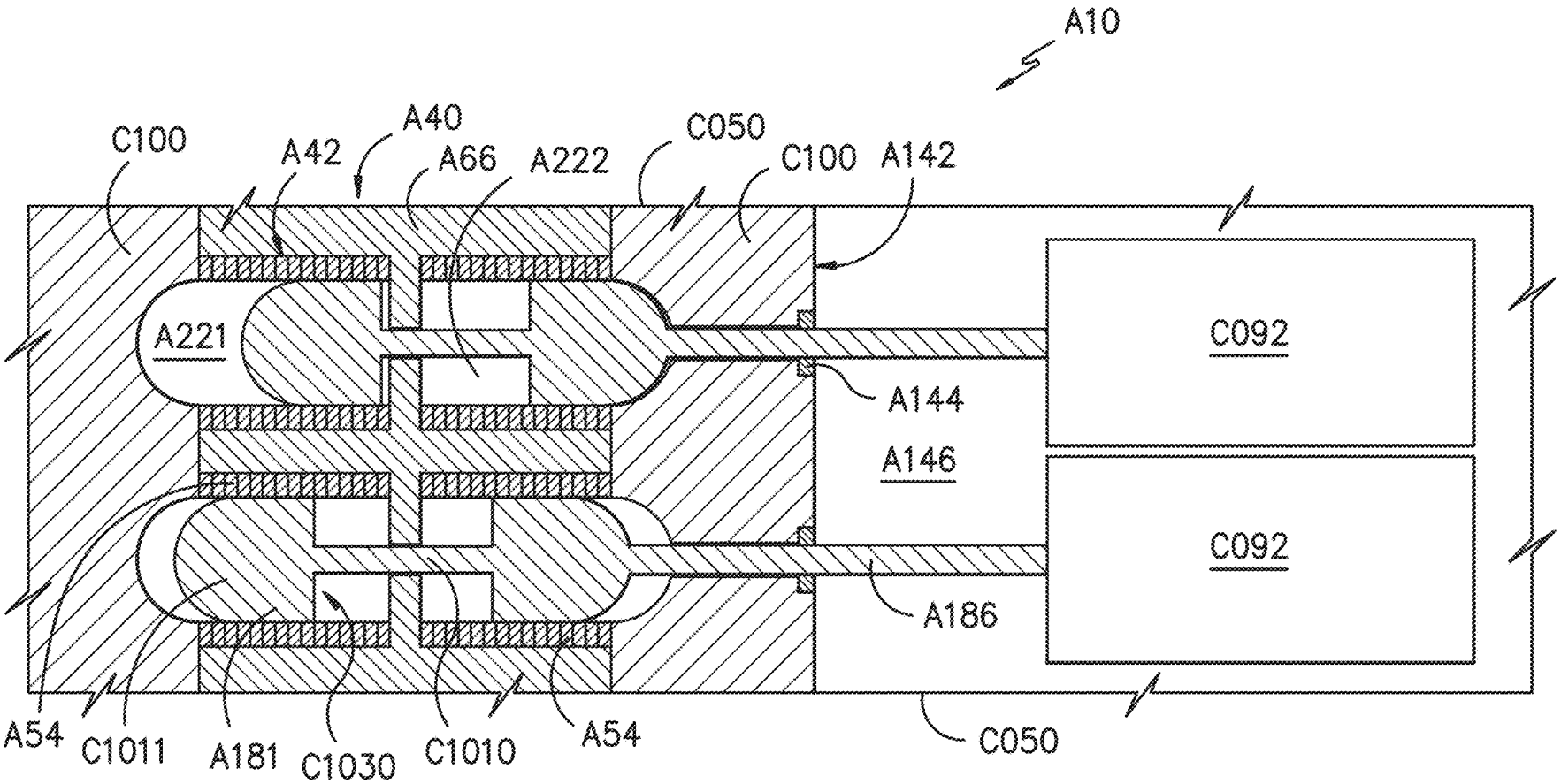
FIG. 9 is a schematic view of another embodiment of an arrangement of a portion of a system including an engine and a load device according to an aspect of the present disclosure.

Referring now to FIGS. 8 through 9, in various embodiments the chiller assembly includes a chiller casing in which a chiller flowpath is defined next to the compression chamber A222 of the volume. The chiller flowpath may particularly be defined immediately next to or adjacent to the second volume wall defined by the chiller assembly, or particularly the chiller casing, such as depicted in regard to FIG. 8. The chiller assembly includes the second volume wall and further includes the inner end wall A50 such as described in regard to FIG. 2-FIG. 3. The second volume wall and the inner end wall A50 may together define a single monolithic structure. Furthermore, the chiller casing may include the second volume wall and the inner end wall A50 and define the chiller flowpath as a single monolithic structure. As such, the structure and method for assembly and improved thermal efficiency may include positioning pistons A1011 and the connection member A1030 through the chiller assembly, operably coupling the pistons A1011 and the connection member A1030 together as the piston assembly A1010, and closing or sealing the expansion chamber A221 and compression chamber A222 via the heater body at the outer ends A103 of the closed cycle engine.

Figure 10:
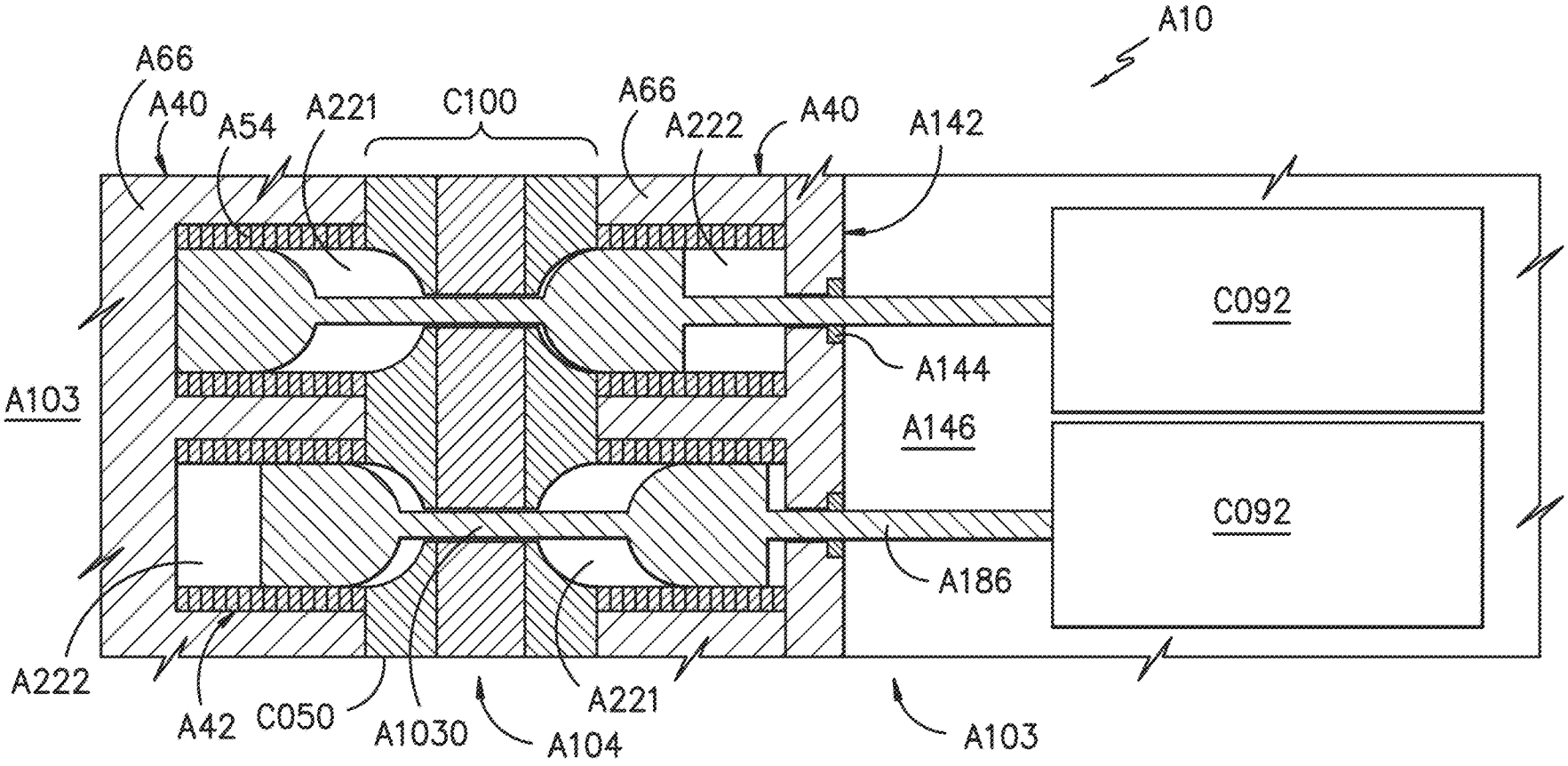
FIG. 10 is a schematic view of yet another embodiment of an arrangement of a portion of a system including an engine and a load device according to an aspect of the present disclosure.

Referring now to FIGS. 9 through 10, in various embodiments the load device c092 is positioned at one or more outer ends A103 of the closed cycle engine in operative communication with the piston assembly A1010. The system A10 may further include an extension member A186 connected to one or more pistons A1011 of the piston assembly A1010. The extension member A186 is connected to the piston A1011 and extended laterally outward toward one or more outer ends A103. The extension member A186 is operatively connected to the load device c092 such that lateral movement of the piston assembly A1010 including the extension member A186 generates electric energy at the electric machine. Although not further depicted in regard to FIGS. 8-9, the extension member A186 further includes the dynamic member A181 at the load device c092 defining the electric machine operatively coupled to the electric machine in magnetic communication with the stator assembly A182, such as depicted and described in regard to FIGS. 2-3.

Referring still to FIGS. 9 through 10, the machine body c918 surrounding the load device c092 includes an interface wall A142 in contact with the outer end A103 of the load device c092. Within the machine body c918 and around the load device c092 is a cavity A146. The interface wall A142 includes a seal A144, such as a gap seal, at an interface of the extension member A186 and the interface wall A142. The cavity A146 may particularly define a pressurized cavity such that pressurization at the volume within the piston body C700, such as at the expansion chamber A221, is substantially maintained or mitigated from pressure loss within the expansion chamber A221 along the extension member A186. It should be appreciated that any suitable type of seal may be incorporated at the interface wall A142 such as to substantially maintain pressure at the expansion chamber A221, or provide an acceptably low rate of leakage over time from the expansion chamber A221.

Regarding FIG. 9, and similarly as shown and described in regard to FIGS. 2 through 8, the heater body is positioned at outer ends A103 of the closed cycle engine. In regard to the embodiment depicted in FIG. 10, the heater body is positioned at the inner end A104 of the closed cycle engine between each pair of piston bodies C700 at which each respective piston A1011 of the piston assembly A1010 is contained. The heater body may particularly define a single common heater body such as to provide a single thermal energy output source to each expansion chamber A221 of the closed cycle engine.

Figure 4:
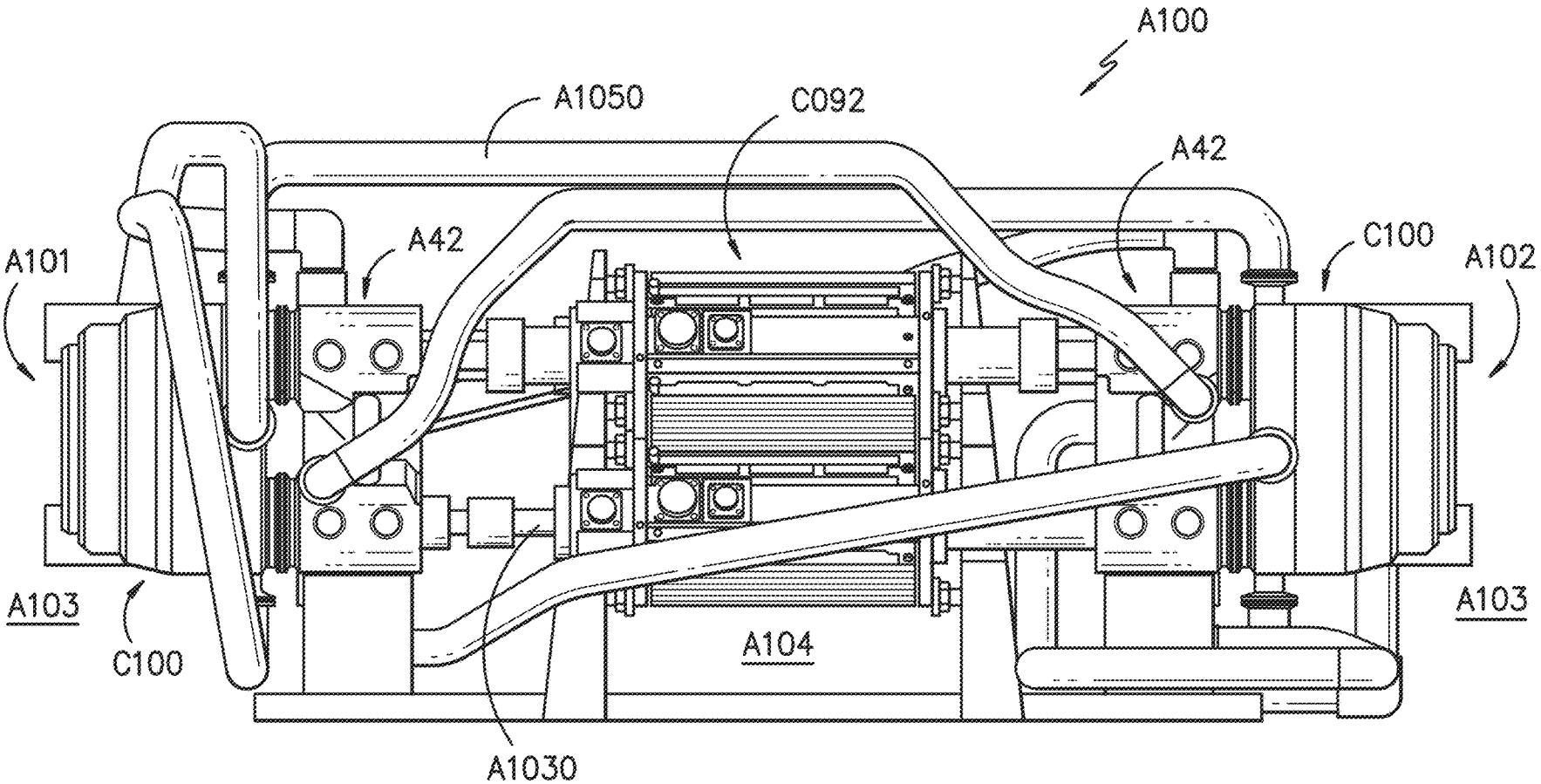
FIG. 4 is a side view of an exemplary embodiment of a portion of an engine according to an aspect of the present disclosure.
Figure 5:
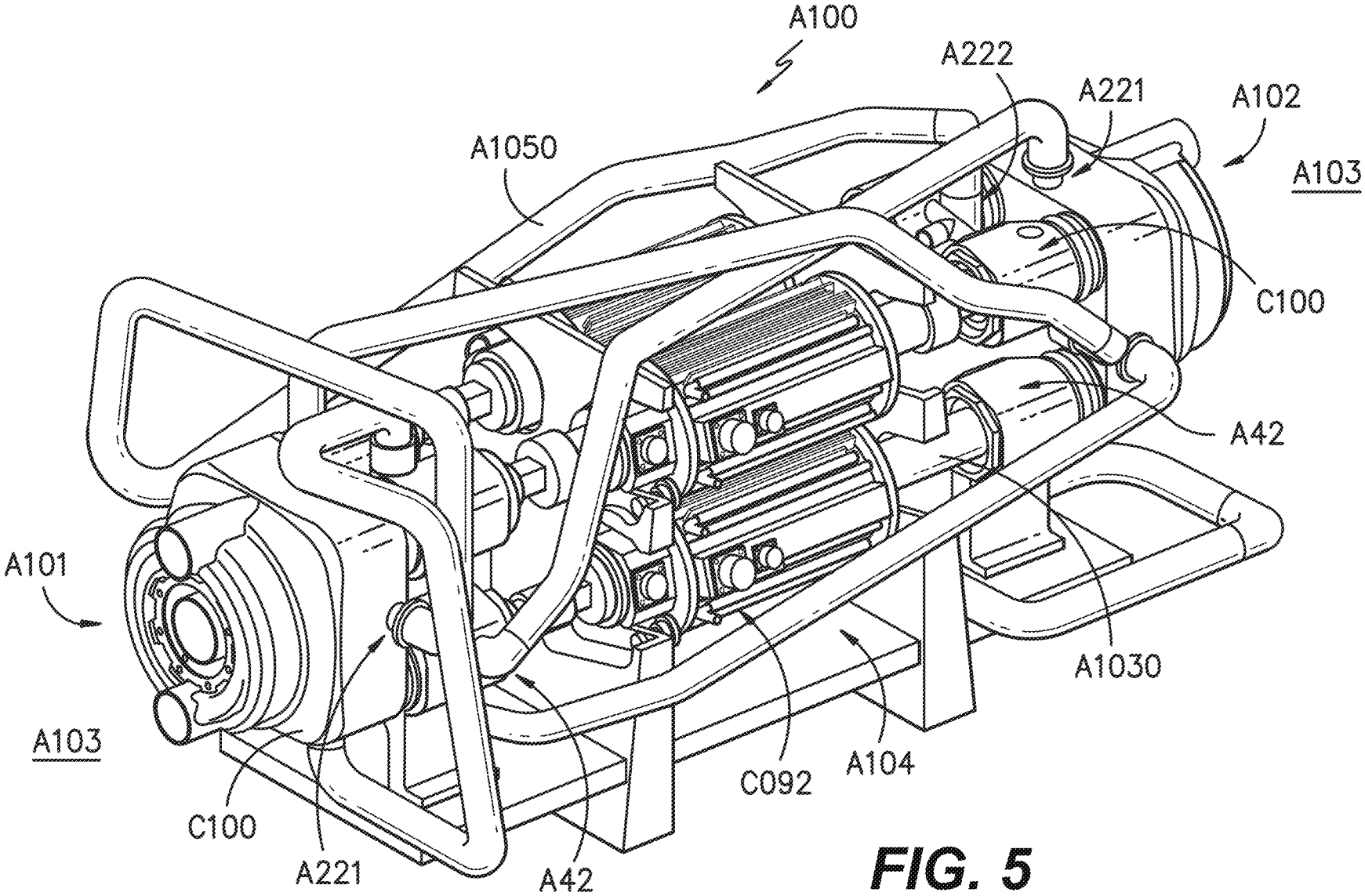
FIG. 5 is a perspective view of an exemplary embodiment of a portion of an engine such as provided in regard to FIG. 4.
Figure 6:
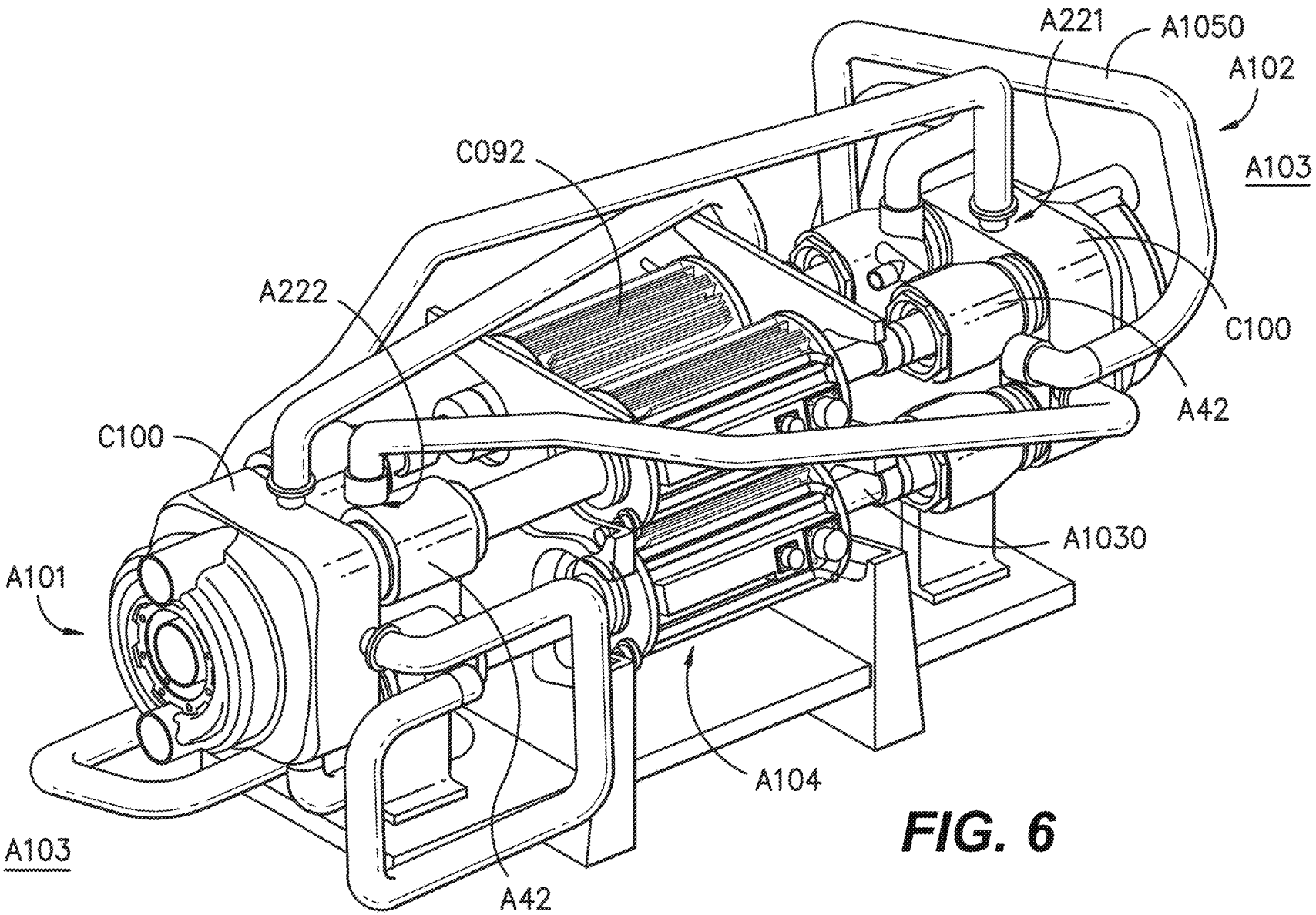
FIG. 6 is another perspective view of an exemplary embodiment of a portion of an engine such as provided in regard to FIGS. 4 through 5.
Figure 7:
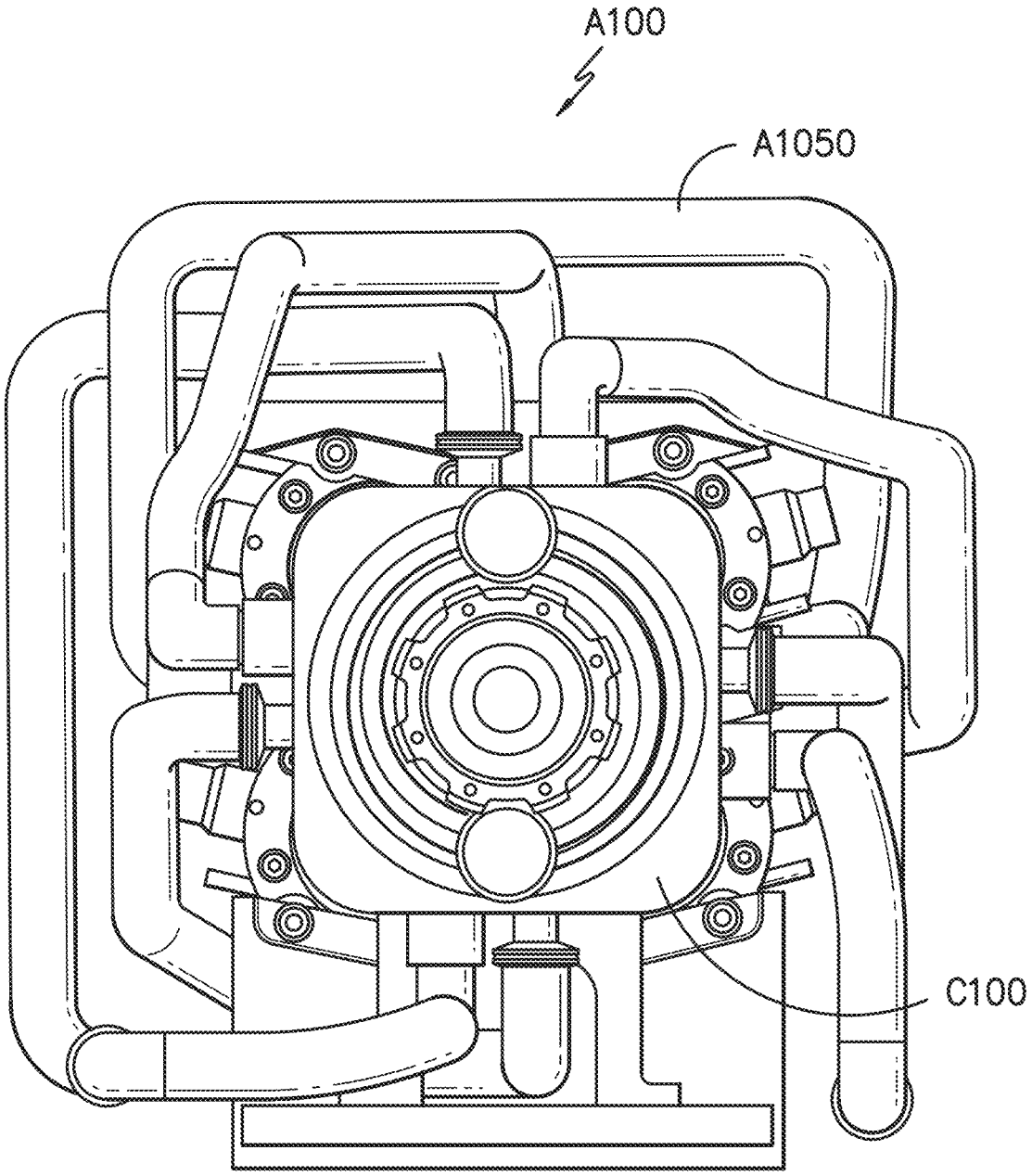
FIG. 7 is an end view of an exemplary embodiment of a portion of an engine such as provided in regard to FIGS. 4 through 5.

Referring to FIG. 10 and further in regard to the embodiment and description regarding FIGS. 4 through 5, the single common heater body may be positioned to provide a substantially uniform thermal energy output to all eight expansion chambers A221 of the closed cycle engine. The single common heater body positioned between the expansion chambers A221 may alleviate or obviate issues that may arise from uneven thermal input to the expansion chambers A221. For example, the single common heater body may mitigate phase drifting of the piston assemblies A1010 relative to one another. As such, the single common heater body may promote balanced pressure operation of the closed cycle engine, mitigate unbalanced operation, reduce vibrations or mitigate promulgation of vibrations, improve efficiency of the system A10, or promote improved operability of the system A10.

It should be appreciated that various embodiments of the system A10 provided in regard to FIGS. 1 through 10 are further configured to provide a desired thermal energy output from the heater body to the expansion chambers A221. For example, the embodiments shown and described herein may be configured to output a substantially uniform thermal energy profile from each heater body to all expansion chambers A221. In still various embodiments, the chiller assembly includes the chiller working fluid input and the chiller working fluid output such as depicted and described in regard to FIGS. 4 through 5, such as to provide a substantially uniform thermal energy output from the compression chamber A222 to the chiller assembly.

Figure 11:
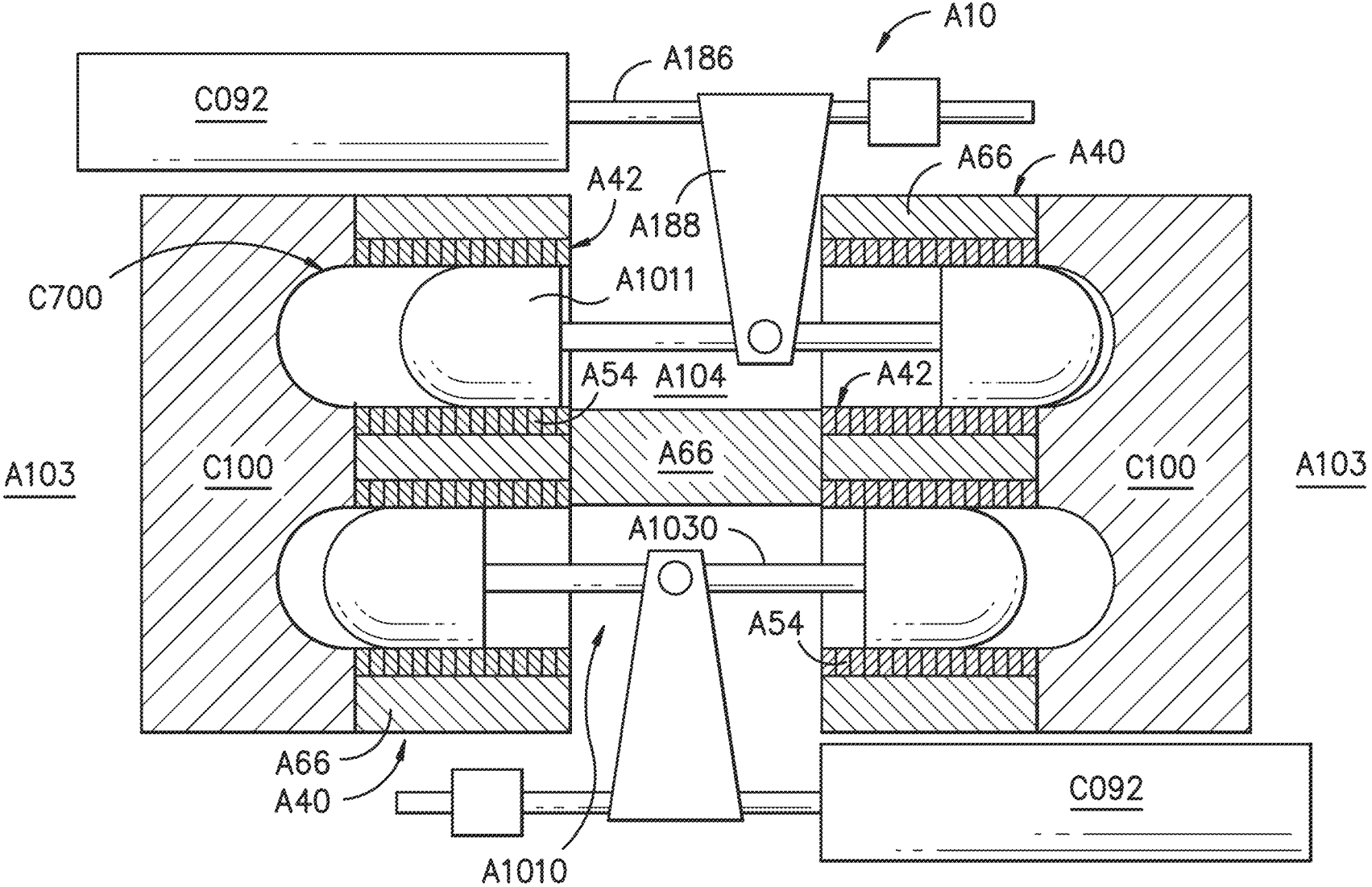
FIG. 11 is a schematic view of still another embodiment of an arrangement of a portion of a system including an engine and a load device according to an aspect of the present disclosure.

Referring now to FIG. 11, the schematic embodiment provided is configured substantially similarly as shown and described in regard to FIGS. 1 through 10. In the embodiment depicted in FIG. 11, the system A10 further includes an adapter A188 attaching the connection member A1030 to the extension member A186. In various embodiments, the adapter A188 is extended along a transverse direction generally acute to the lateral direction L. In one embodiment, the adapter A188 is extended substantially perpendicular to the lateral direction L. The adapter A188 provides substantially parallel arrangement of the connection member A1030 relative to the extension member A186 such as to translate lateral movement of the connection member A1030 at a first plane to lateral movement of the extension member A186 at a second plane different from the first plane. In various embodiments, the adapter A188 includes a mechanical connection, such as, for example, a rocker arm, to extend from the connection member A1030 to the load device c092. The adapter A188 further provides a diameter, length, or other dimension of the load device c092 to be de-coupled from dimensions of the closed cycle engine. In various embodiments, the adapter A188 provides the dynamic member A181 and/or extension member A186 of the load device c092 to have a stroke or length different from the connection member A1030. The adapter A188 may further provide the load device c092 to include a gearing system, a frequency converter, or other devices to alter or scale the output of the load device c092 from the size or speed of the piston assembly A1010. As such, the closed cycle engine and the load device c092 may each be sized substantially separately for improved performance of each.

In general, the exemplary embodiments of system A10 and engine, or portions thereof, described herein may be manufactured or formed using any suitable process. However, in accordance with several aspects of the present subject matter, some or all of system A10 may be formed using an additive manufacturing process, such as a 3-D printing process. The use of such a process may allow portions of the system A10 to be formed integrally, as a single monolithic component, or as any suitable number of sub-components. In various embodiments, the manufacturing process may allow the all or part of the heater body, the chiller assembly, the load device c092, or the engine to be integrally formed and include a variety of features not possible when using prior manufacturing methods. For example, the additive manufacturing methods described herein provide the manufacture of the system A10 having unique features, configurations, thicknesses, materials, densities, and structures not possible using prior manufacturing methods. Some of these novel features can, for example, improve thermal energy transfer between two or more components, improve thermal energy transfer to the engine working fluid, improve thermal energy transfer from the engine working fluid to the chiller working fluid, reduce leakages, or facilitate assembly, or generally improve thermal efficiency, power generation and output, or power density of the system A10 using an additive manufacturing process as described herein.

Various embodiments of the system A10 and engine A100 shown and described herein provide desired power outputs, power densities, or efficiencies, or combinations thereof, based on one or more elements, arrangements, flowpaths, conduits, surface areas, volumes, or assemblies, or methods thereof, provided herein. Efficiencies described herein may include $T_{Hot,engine}$ corresponding to temperature input to the engine working fluid at the heater conduits or working fluid pathways C110 from the hot side heat exchanger C108. Still various embodiments include $T_{Cold,ambient}$ corresponding to temperature removed from the engine working fluid at the chiller conduits A54 to the cold side heat exchanger A42. In other instances, the temperature input may alternatively correspond to heat or thermal energy input to the engine working fluid, such as from the heating working fluid. Still further, the temperature removed may alternatively correspond to heat or thermal energy output from the engine working fluid, such as to the chiller working fluid. In still various embodiments, the environment is the chiller working fluid into which the engine A100 rejects, exhausts, or otherwise releases heat or thermal energy from the engine working fluid at the chiller conduits A54.

In still yet various embodiments, efficiencies described herein may include $Q_{Out}$ corresponding to thermal energy received by the engine working fluid at the heater conduits or working fluid pathways C110 from the hot side heat exchanger C108. Still various embodiments include $Q_{in}$ corresponding to thermal energy received at the chiller working fluid at the chiller working fluid passage A56 at the cold side heat exchanger A42 from the engine working fluid at the chiller conduits A54.

In still another embodiment, $E_{out}$ is the net electrical energy output from the load device C092 that is operatively coupled to the engine A100 via the piston assembly C1010.

In various embodiments, the features, arrangements, surface areas, volumes, or ratios thereof provide the engine A100 to operate at higher efficiencies over known closed cycle engines, or Stirling engines particularly. Various embodiments of the system A10 provided herein may be configured to produce mechanical power output from the piston assembly A1010 at a Carnot efficiency $\eta_{carnot}$ of up to approximately 80%. In some embodiments, the system A10 provided herein may be configured to produce mechanical power output from the piston assembly A1010 at an efficiency of up to approximately 80% cold environments, such as in space. In one embodiment, the Carnot efficiency corresponds to the thermal efficiency of the engine A100 receiving thermal energy or heat at the heater conduits C110 and expelling thermal energy or heat from the engine working fluid at the chiller conduits A54. In one embodiment, the Carnot efficiency corresponds at least to the engine A100 including the hot side heat exchanger C108 and the cold side heat exchanger A42, such as depicted at the engine level efficiency (FIG. 1).

Various embodiments of the system A10 provided herein may be configured to produce mechanical power output from the piston assembly A1010 at electrical efficiency of up to approximately 80%. In one embodiment, the electrical efficiency corresponds to the useful work generated by the engine A100 receiving heat or thermal energy from the heating working fluid and releasing heat or thermal energy to the chiller working fluid and converted into electrical energy via the load device C092, such as depicted within area A106 in FIG. 1. In one embodiment, the electrical efficiency corresponds at least to the system A10 including the engine A100, the heater body C100, and the chiller assembly A40, such as depicted at the system level efficiency (FIG. 1).

In one embodiment, the system A10 provides a temperature differential via the heater body C100 and the chiller assembly C40 in which the engine A100 generates mechanical power output between 1 kW and 100 kW relative to the piston assembly A1010. In another embodiment, the system A10 is configured to generate between 10 kW and 100 kW. In yet another embodiment, the system A10 is configured to generate between 25 kW and 100 kW. In yet another embodiment, the system A10 may be configured to produce greater than 100 kW. For example, the system A10 may include a plurality of the engine A100 operably coupled at two or more piston assemblies A1010 and the load device c092 to produce greater than 100 kW. In various embodiments, a plurality of the engine A100 may be operably coupled to produce up to 5 megawatts.

In various embodiments, the engine A100 further defines a ratio of mechanical power output from the piston assembly A1010 to maximum cycle volume of the working fluid between 0.0005 and 0.0040 kW per cubic centimeter (cc) for a given efficiency. In various embodiments, the ratio of mechanical power output from the piston assembly A1010 to maximum cycle volume of the working fluid is a range of maximum ratio at which the mechanical power output from the piston assembly A1010 to maximum cycle volume of the working fluid is defined. In some embodiments, the engine A100 defines a maximum ratio of mechanical power output from the piston assembly A1010 to maximum cycle volume of the working fluid between 0.0005 and 0.0040 kW generated from the piston assembly A1010 for one cubic centimeter of engine working fluid at an engine efficiency of at least 50%. Stated differently, between 0.0005 and 0.0040 kW is generated from the piston assembly A1010 for one cubic centimeter of engine working fluid at an engine efficiency of at least 50%. In various embodiments, the engine A100 defines a ratio of mechanical power output from the piston assembly A1010 to the maximum cycle volume of the working fluid between 0.0010 and 0.0030 kW/cc at an engine efficiency of at least 50%. In another embodiment, the engine A100 defines a ratio of mechanical power output from the piston assembly A1010 to the maximum cycle volume of the working fluid between 0.0015 and 0.0025 kW/cc at an engine efficiency of at least 50%. In one embodiment, the system A10 defines the ratio of mechanical power output from the piston assembly A1010 to maximum cycle volume of the working fluid between 0.0005 kW/cc and 0.0040 kW/cc at a Carnot efficiency of the engine of up to 80%. In another embodiment, the engine A100 defines the ratio of mechanical power output from the piston assembly A1010 to maximum cycle volume of the working fluid between 0.0005 kW/cc and 0.0040 kW/cc with an efficiency of the engine A100 of up to 60%.

Various embodiments of the system A10 shown and described herein provide a power density by efficiency that may be advantageous over certain power generation or energy conversion systems including engine and heat exchanger systems. In some embodiments, the system A10 includes a power density (kW/m$^3$) by system level efficiency greater than 51. For example, the power density is power output at the load device c092 over volume of the engine working fluid at the engine A100. In particular embodiments, the system A10 includes the power density over maximum cycle volume of the engine working fluid at the engine A100. In some embodiments, the system A10 includes a power density (kW/m$^3$) by efficiency greater than 100. In still other embodiments, the system A10 includes a power density (kW/m$^3$) by efficiency greater than 255. In various embodiments, the system A10 includes a power density (kW/m$^3$) by efficiency less than 400. In other embodiments, the system A10 includes a power density (kW/m$^3$) by efficiency less than 125. In still various embodiments, the system A10 includes a power density (kW/m$^3$) by efficiency between 51 and 400.

In still various embodiments, the engine A100 defines the efficiencies and ratio of mechanical power output from the piston assembly A1010 to maximum cycle volume of the engine working fluid with a temperature differential of the engine working fluid at the expansion chamber A221 and the compression chamber A222 of at least 630 degrees Celsius. In one embodiment, the cold side heat exchanger A42 is configured to reduce the temperature of the engine working fluid at the chiller conduits A54 and/or compression chamber A222 less than 120 degrees Celsius. In another embodiment, the cold side heat exchanger A42 is configured to reduce the temperature of the engine working fluid at the chiller conduits A54 or compression chamber A222 to between approximately −20 degrees Celsius and approximately 120 degrees Celsius on average during steady-state full power operation. In still another embodiment, the cold side heat exchanger A42 is configured to reduce the temperature of the engine working fluid at the chiller conduits A54 or compression chamber A222 to between 20 degrees Celsius and approximately 120 degrees Celsius on average during steady-state full power operation. In yet another embodiment, the hot side heat exchanger C108 is configured to heat the engine working fluid at the heater conduits C110 or expansion chamber A221 to at least 750 degrees Celsius. However, it should be appreciated that an upper limit of the heat provided to the hot side heat exchanger C108 or the expansion chamber A221 is based at least on materials limits, such as one or materials listed or described herein, or another suitable material for constructing the engine and/or system. Material limits may include, but are not limited to, a melting point, tensile stress, yield stress, deformation or deflection limits, or desired life or durability of the engine.

Chapter 2—Balance of Plant

Notarnicola Cycle as Bottoming Cycle to Stirling Engine

Figure 12:
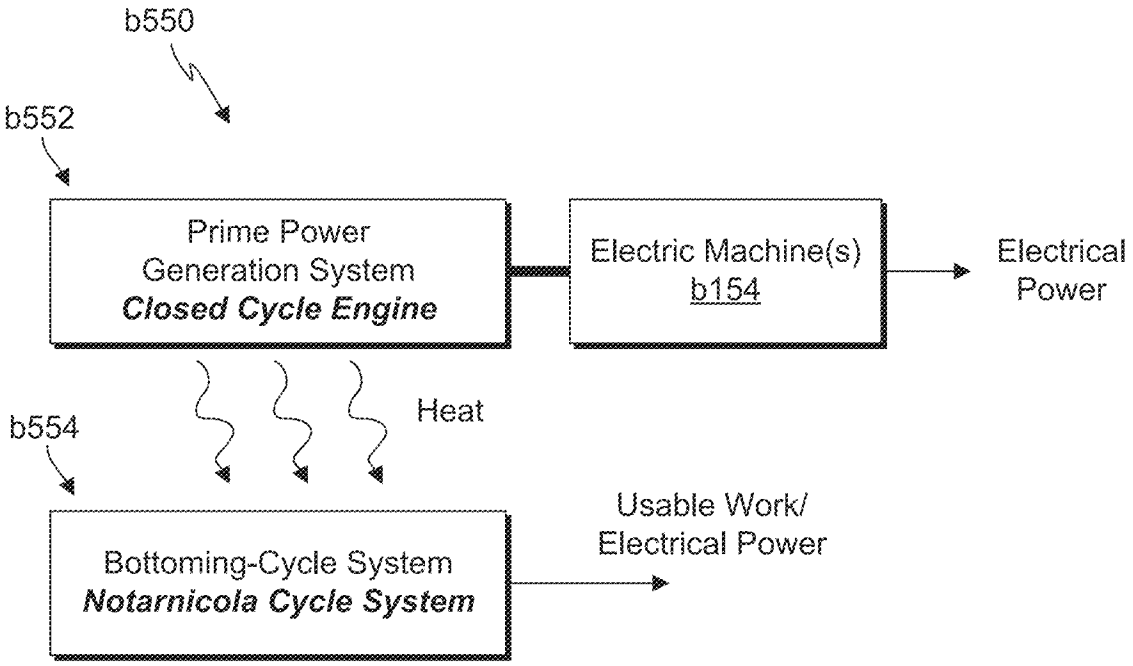
FIG. 12 provides a schematic view of a power generation system according to an example embodiment of the present disclosure.

FIG. 12 provides a schematic view of a power generation system b550 according to an example embodiment of the present disclosure. The power generation system b550 includes a prime power generation system b552 and a heat recovery or bottoming-cycle system b554 operable to recover heat from the prime power generation system b552 and use the recovered heat to produce useful mechanical work. The mechanical work can be used for various applications, such as generating electrical power and/or driving various elements operatively coupled thereto.

As depicted in FIG. 12, for this embodiment, the prime power generation system b552 includes a closed cycle engine operable to produce useful work. In other embodiments, the prime power generation system b552 can include other suitable types of power generators, including for example, a gas or steam turbine engine, solar panels, etc. The useful work produced by the closed cycle engine can be used for any suitable purpose, such as for causing one or more electric machines b154 operatively coupled thereto to generate electrical power. The closed cycle engine can be any of the closed cycle engines described herein, including for example, any of the Stirling engines described herein. As will be explained further below, heat from the closed cycle engine, or the heat source in this example, can be recovered/extracted and used by the bottoming-cycle system b554 to produce useful mechanical work. For instance, heat can be recovered from the cold side and/or the hot side of the closed cycle engine and used by the bottoming-cycle system b554 to produce useful mechanical work. The useful work produced by the bottoming-cycle system b554 can be used in turn to drive one or more elements, such as e.g., a compressor. Moreover, in some embodiments, one or more electric machines can be operatively coupled with components of the bottoming-cycle system b554. In this way, the mechanical work can be used for generating electrical power. Furthermore, notably, the bottoming-cycle system b554 of FIG. 12 is a Notarnicola cycle system that operates on a Notarnicola Cycle, or stated another way, on a constant density heat addition principle as will be explained below.

Figure 13:
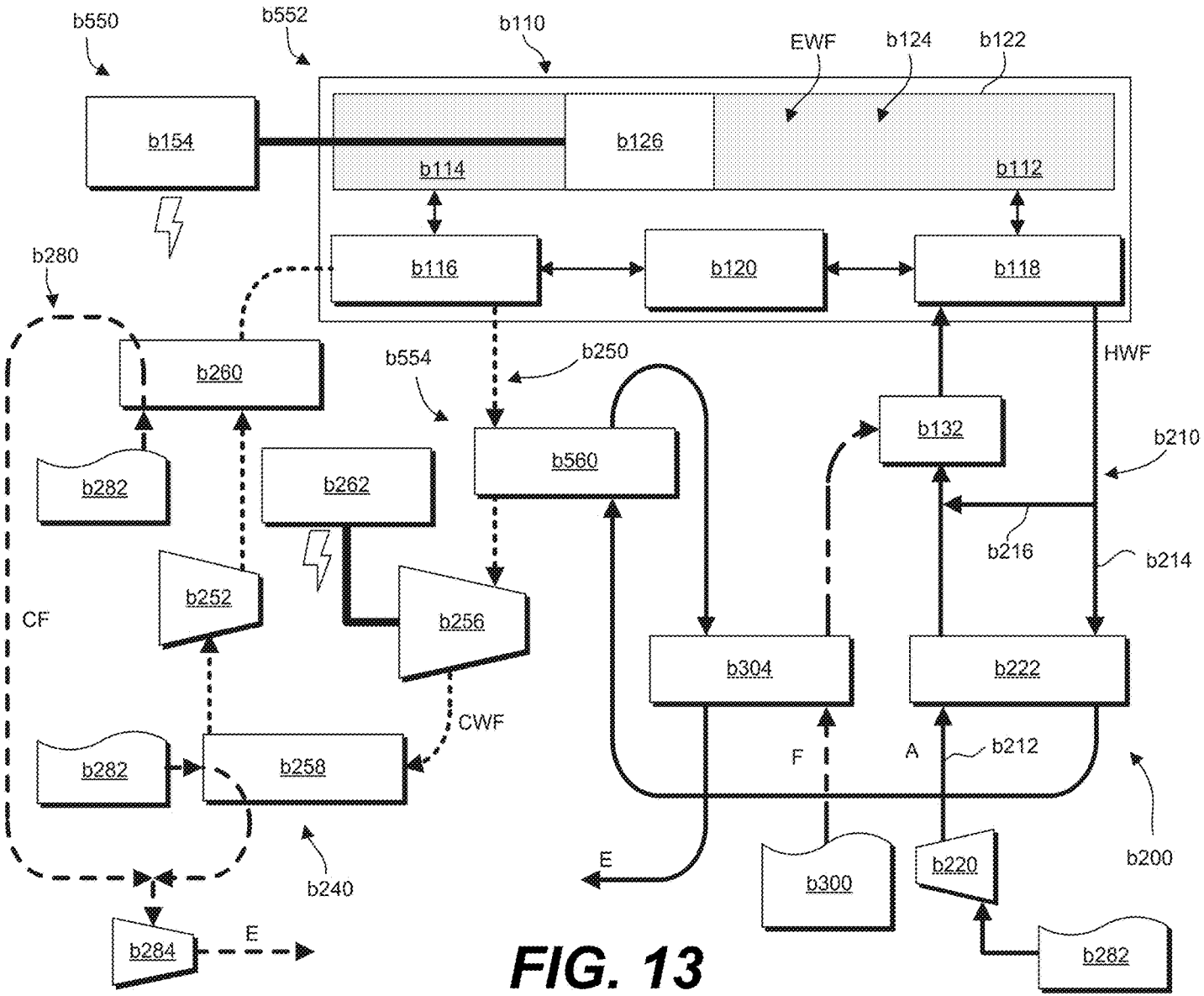
FIG. 13 provides a schematic view of a power generation system according to an example embodiment of the present disclosure.

FIG. 13 provides a schematic view of a power generation system b550 according to an example embodiment of the present disclosure. Generally, the power generation system b550 of FIG. 13 includes a prime power generation system b552 and a balance of plant b200. The balance of plant b200 includes a heat recovery system to recover heat from the prime power generation system b552. Particularly, the heat recovery system operates a Notarnicola Cycle-based bottoming cycle to recover heat (e.g., engine exhaust) generated by the prime power generation system b552. The recovered heat can then be used in a useful way. For instance, the energy recovered by the heat recovery system can be used to "pay" for pumps and other accessories associated with the balance of plant b200 so such components do not rob the closed cycle engine b110 of efficiency. Further, in some embodiments, some or all of the balance of plant b200 components can be additively manufactured, e.g., by one or more of the additive manufacturing techniques described herein. In this way, the costs associated with manufacturing such components can minimized, particularly for relatively smaller mobile applications.

As depicted in FIG. 13, the prime power generation system b552 of the power generation system b550 is a closed cycle engine b110. The closed cycle engine b110 can be any of the closed cycle engines described herein. For instance, the closed cycle engine b110 can be one of the Stirling engines described herein. The closed cycle engine b110 includes one or more piston assemblies b126 each movable within their respective piston bodies b122. Additionally, the closed cycle engine b110 includes a regenerator b120, a hot side heat exchanger b118 operable to heat or impart thermal energy to the working fluid within the piston bodies b122, and a cold side heat exchanger b116 operable to remove heat from the working fluid within the piston bodies b122. Consequently, the closed cycle engine b110 generally defines a hot side b112 and a cold side b114. Furthermore, as shown, one or more electric machines b154 are operatively coupled with the piston assemblies b126. When the piston assemblies b126 are moved within their respective piston bodies b122, the electric machines b154 are operable to generate electrical power.

Generally, the balance of plant b200 of the power generation system b550 includes a heater loop b210 and a chiller loop b240. Notably for this embodiment, the heater loop b210 is positioned at least in part in a heat exchange relationship with the chiller loop b240. Accordingly, as will be explained below, heat captured from the hot side b112 of the engine can be used as a heat source for increasing the temperature of the chiller working fluid CWF flowing along the bottoming-cycle loop b250 to ultimately increase the potential energy thereof. In this way, more or supplemental electrical power can be generated by the one or more electric machines b262 operatively coupled with the expansion device b256 of the chiller loop b240. Additionally, heat can be captured from the hot side b112 of the engine and fed directly back to the engine or to one or more components for increasing the temperature of fuel and/or air flowing to the combustor b132.

For this embodiment, the heater loop b210 includes a compressor b220 positioned along an intake line b212 of the heater loop b210. The compressor b220 moves air into the heater loop b210 from an air source b218 (e.g., an ambient environment) and pressurizes the air. A recuperator b222 is positioned downstream of the compressor b220 along the intake line b212 of the heater loop b210 as well as along a heat recovery loop b214 of the heater loop b210. The air pressurized by the compressor b220 flows downstream to the recuperator b222 along the intake line b212 where the pressurized air is pre-heated by hot combustion gases recovered from the closed cycle engine b110, or more particularly, from the hot side heat exchanger b118 of the closed cycle engine b110. As the pressurized and now pre-heated air flows downstream, the pressurized/pre-heated air combines or mixes with hot combustion gases recirculated from the hot side heat exchanger b118, e.g., via a recirculation loop b216 of the heat recovery loop b214.

The heated air mixes with fuel and the fuel/air mixture is combusted in a combustor b132 or burner of the closed cycle engine b110. The combustion gases generated by the combustion process are provided to the hot side heat exchanger b118 via the intake line b212. The hot side heat exchanger b118 facilitates heat exchange between the hot combustion gases and the engine working fluid EWF within the piston body b122. The heat imparted to the engine working fluid EWF creates a temperature differential between the hot side b112 and the cold side b114 of the closed cycle engine b110. The expansion and compression of the engine working fluid EWF causes the piston assemblies b126 to move within their respective piston bodies b122, thereby producing useful work. The useful mechanical work can be converted into electrical power, e.g., by the one or more electric machines b154 operatively coupled with the piston assemblies b126.

After the relatively hot combustion gases impart thermal energy to the engine working fluid EWF within the piston body b122, the combustion gases are captured and directed downstream along the heat recovery loop b214 for further useful purposes. For instance, a portion of the combustion gases are recirculated via the recirculation loop b216 back to the combustor b132 and a portion of the combustion gases are used to impart thermal energy to the pressurized air passing through the recuperator b222. That is, a portion of the combustion gases are used to preheat the incoming pressurized air at the recuperator b222.

After flowing through the recuperator b222, the hot combustion gases recovered from the hot side heat exchanger b118 of the closed cycle engine b110 continue downstream along the heat recovery loop b214 to a constant density heat exchanger b560 of the chiller loop b240. Thus, as noted above, the heater loop b210 is at least in part in a heat exchange relationship with the chiller loop b240. Particularly, for this embodiment, the heater loop b210 is at least in part in a heat exchange relationship with the chiller loop b240 at the constant density heat exchanger b560. The hot combustion gases heat or impart thermal energy to the chiller working fluid CWF flowing through the bottoming-cycle loop b250 at the constant density heat exchanger b560. In this way, the temperature of the chiller working fluid CWF is increased even further prior to expanding at the expansion device b256 downstream of the constant density heat exchanger b560. The increased potential energy of the chiller working fluid CWF allows the expansion device b256 to extract more useful work therefrom. Accordingly, more electrical power can be generated by the one or more electric machines b262 operatively coupled with the expansion device b256.

For this embodiment, the constant density heat exchanger b560 positioned along the bottoming-cycle loop b250 of the chiller loop b240 and the heat recovery loop b214 of the heater loop b210 is a constant density heat exchanger. As such, the chiller working fluid CWF flowing through the bottoming-cycle loop b250 at the constant density heat exchanger b560 can be held at constant density during heat application to increase the temperature and pressure of the chiller working fluid CWF. The hot combustion gases or heating working fluid HWF flowing through the heat recovery loop b214 apply heat to the chiller working fluid CWF held at constant density at the constant density heat exchanger b560.

After imparting thermal energy to the chiller working fluid CWF at the constant density heat exchanger b560, the combustion gases flow downstream along the heat recovery loop b214 to the fuel preheater b304. The combustion gases impart thermal energy to fuel flowing downstream along a fuel line 302 from a fuel source b300 (e.g., a fuel tank) at the fuel preheater b304. In this way, the fuel can be preheated prior to being mixed with the heated/pressurized air. Preheating the fuel prior to mixing with the heated/pressurized air can reduce the amount of fuel required for the same work output. After heat exchange at the fuel preheater b304, the combustion gases flow downstream along the heat recovery loop b214 of the heater loop b210 and are exhausted from the system.

Notably, for this embodiment, the heat recovered from the hot side heat exchanger b118 is exchanged with the various elements along the heater loop b210 in an ordered manner to achieve high efficiency of the power generation system b100. For instance, for the depicted embodiment of FIG. 13, the thermal energy generated by the combustor b132 is first used by the hot side heat exchanger b118 to heat the engine working fluid EWF within the piston body b122. Thereafter, the hot combustion gases continue downstream. Some of the recovered combustion gases are directed back to the combustor b132 via the recirculation loop b216 and some of the combustion gases are directed to the recuperator b222 for pre-heating the compressed air, which also returns heat to the engine. Next, the hot combustion gases are used to heat the chiller working fluid CWF flowing along the bottoming-cycle loop b250 at the constant density heat exchanger b560. The hot combustion gases are then used to pre-heat the fuel at the fuel preheater b304, thereby returning heat to the engine. Finally, the combustion gases are exhausted from the system.

The chiller loop b240 of the balance of plant b200 is operable to remove heat or thermal energy from the cold side b114 of the closed cycle engine b110. Particularly, a working fluid can be passed through the cold side heat exchanger b116. The engine working fluid EWF can exchange heat with the relatively cool working fluid flowing through the cold side heat exchanger b116, and thus, the working fluid removes heat from the closed cycle engine b110 to provide cooling thereto, e.g., at the cold side b114. The cooled engine working fluid EWF facilitates compression thereof when the piston assembly b126 is moved toward the compression space by the expansion of the working fluid at the other end of the regenerative engine.

As illustrated in FIG. 13, the chiller loop b240 includes two linked loops, including a bottoming-cycle loop b250 and a cooling loop b280. The bottoming-cycle loop b250 or system is a recovered heat to power system. Particularly, a chiller working fluid CWF, such as e.g., a supercritical carbon dioxide or some other suitable low temperature working fluid, is moved through the bottoming-cycle loop b250 to remove heat from the cold side b114 of the engine (e.g., to increase the temperature differential between the hot and cold sides of the engine). Components of the bottoming-cycle loop b250 utilize the captured heat to generate electrical power. The cooling loop b280 is operable to cool certain components positioned along the bottoming-cycle loop b250. Specifically, a cooling fluid CF, such as e.g., ambient air or some other suitable heat-sink fluid, is moved through the cooling loop b280 and exchanges heat with the various components of the bottoming-cycle loop b250 to provide cooling thereto. The chiller loop b240 will be described in detail below.

For this embodiment, the bottoming-cycle loop b250 of the chiller loop b240 includes a pump b252 operable to move the chiller working fluid CWF along or through the bottoming-cycle loop b250. As noted above, the chiller working fluid CWF can be a supercritical carbon dioxide fluid or some other suitable low temperature working fluid. A precooler b260 is optionally positioned downstream of the pump b252 along the bottoming-cycle loop b250. The precooler b260 cools the chiller working fluid CWF as the chiller working fluid CWF flows therethrough. The cold side heat exchanger b116 (e.g., an evaporator) is positioned downstream of the precooler b260 along the bottoming-cycle loop b250. The cold side heat exchanger b116 is positioned in a heat exchange relationship with the cold side b114 of the closed cycle engine b110 as shown in FIG. 13. During operation of the closed cycle engine b110, the chiller working fluid CWF flowing through the cold side heat exchanger b116 picks up or removes heat from the engine working fluid EWF and walls of the piston body b122 at or proximate the cold side b114 of the engine b110. That is, the engine working fluid EWF and walls at or proximate the cold side b114 of the engine b110 impart thermal energy to the chiller working fluid CWF flowing through the cold side heat exchanger b116. Accordingly, the heat captured from the cold side b114 of the engine b110 can be utilized to generate electrical power and/or produce useful work.

In some embodiments, the relatively hot chiller working fluid CWF flows downstream from the cold side heat exchanger b116 to the constant density heat exchanger b560 or second heat exchanger positioned along the bottoming-cycle loop b250. For this embodiment, the heat source b134 that imparts thermal energy to the chiller working fluid CWF flowing through the bottoming-cycle loop b250 at the constant density heat exchanger b560 is the hot combustion gases flowing along the heat recovery loop b214 of the heater loop b210. Accordingly, heat recovered from the hot side b112 of the engine is utilized for electrical power generation.

An expansion device b256 is positioned downstream of the cold side heat exchanger b116 along the bottoming-cycle loop b250. In some embodiments, the expansion device b256 is immediately downstream of the cold side heat exchanger b116. In yet other embodiments, as noted above, the expansion device b256 is downstream of the cold side heat exchanger b116 but directly downstream of the constant density heat exchanger b560. The expansion device b256 can be a turbine, for example. The expansion device b256 can be operatively coupled with one or more elements of the chiller loop b240 and/or the heater loop b210. For instance, the expansion device b256 can be mechanically coupled with the pump b252 of the bottoming-cycle loop b250, the compressor b220 of the heater loop b210, and/or a fan b284 of the cooling loop b280 of the chiller loop b240, among other components. The expansion device b256 can be mechanically coupled with such components via one or more shafts or a shaft system. The expansion device b256 is operable to extract thermal energy from the chiller working fluid CWF to produce useful work such that electrical power can be generated. Particularly, the expansion of the chiller working fluid CWF can drivingly rotate the expansion device b256 about its axis of rotation, which in turn drives the one or more shafts and the components operatively coupled thereto. Moreover, when the shaft system is driven by rotation of the expansion device b256, the useful work produced can be utilized to drive one or more electric machines b262 operatively coupled to the expansion device b256. In this way, the electric machines b262 can generate electrical power. The electrical power generated can be used to pay or operate the various devices or components of the power generation system b100, such as e.g., fans, pumps, outside air conditioning units, onboard vehicle systems, among other potential uses.

After expanding at the expansion device b256 to produce useful work such that electrical power can ultimately be generated, the chiller working fluid CWF flows downstream from the expansion device b256 to a third heat exchanger b258 or third heat exchanger positioned along the bottoming-cycle loop b250. The third heat exchanger b258 is positioned between the expansion device b256 and the pump b252 along the bottoming-cycle loop b250. The third heat exchanger b258 cools the chiller working fluid CWF before the chiller working fluid CWF flows downstream to the pump b252 where the chiller working fluid CWF is pumped or moved along the bottoming-cycle loop b250 once again.

As noted above, the chiller loop b240 includes the cooling loop b280 linked to the bottoming-cycle loop b250. As depicted in FIG. 13, the cooling fluid CF is introduced into the cooling loop b280 at the precooler b260 via a pressure differential. The relatively cool cooling fluid CF can pick up or remove heat from the chiller working fluid CWF flowing through the bottoming-cycle loop b250 at the precooler b260. That is, the chiller working fluid CWF of the bottoming-cycle loop b250 can impart thermal energy to the cooling fluid CF of the cooling loop b280 at the precooler b260. In addition, cooling fluid CF is introduced into the cooling loop b280 at the third heat exchanger b258 via a pressure differential. The relatively cool cooling fluid CF can pick up heat from the chiller working fluid CWF flowing through the bottoming-cycle loop b250 at the third heat exchanger b258. That is, the chiller working fluid CWF flowing along the bottoming-cycle loop b250 can impart thermal energy to the cooling fluid CF of the cooling loop b280 at the third heat exchanger b258. As illustrated in FIG. 13, the cooling fluid CF can flow downstream from the precooler b260 and downstream from the third heat exchanger b258 to a fan b284 positioned along the cooling loop b280. The fan b284 moves the cooling fluid CF through the cooling loop b280. Particularly, the fan b284 can cause the pressure differential at the inlet of the precooler b260 and the inlet of the third heat exchanger b258 such that the cooling fluid CF is moved into and through the cooling loop b280 of the chiller loop b240. After removing heat from the chiller working fluid CWF flowing through the bottoming-cycle loop b250 at the precooler b260 and the third heat exchanger b258, the cooling fluid CF is exhausted from the system.

As noted above, the constant density heat exchanger b560 is operatively configured to hold a volume of the working fluid WF at constant density during heat application. Stated another way, the constant density heat exchanger b560 is operable to hold a volume of working fluid WF at a fixed density while increasing, via a heat source, the temperature and pressure of the working fluid WF. In some embodiments, the constant density heat exchanger b560 can superheat the working fluid WF. Furthermore, by increasing the pressure of the working fluid WF in addition to increasing the temperature of the working fluid WF, the potential energy of the working fluid WF can be increased, e.g., beyond what is achievable by only heating the working fluid WF, and thus, more useful work can be extracted, e.g., by the expansion device b504. Further, as will be explained below, a working chamber of the constant density heat exchanger b560 is configured to iteratively receive volumes of working fluid. In some embodiments, at least one of the volumes of working fluid received within the working chamber is held at constant density during heat application. In yet other embodiments, each volume of working fluid received within the working chamber is held at constant density during heat application.

Figure 14:
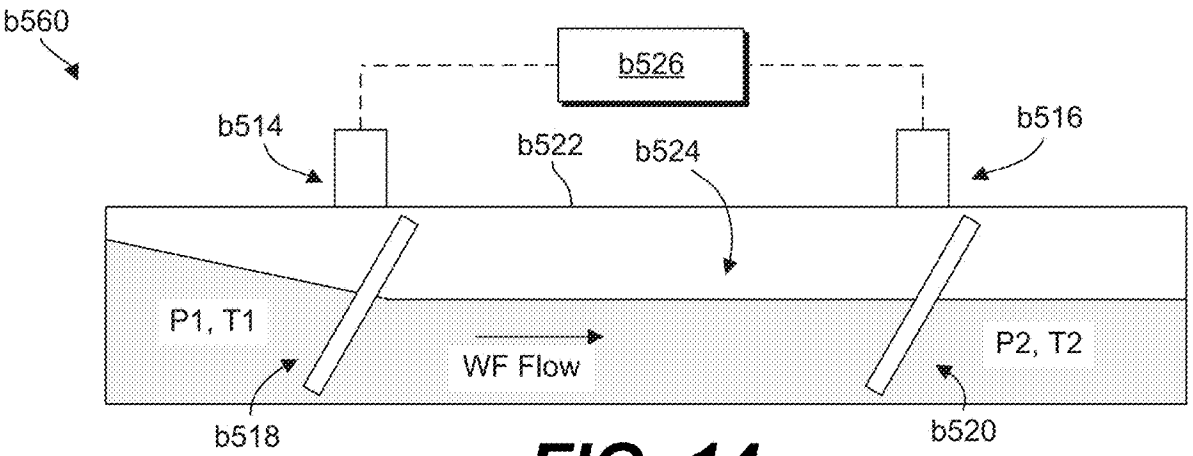
FIGS. 14 and 15 provide schematic close-up views of one embodiment of a constant density heat exchanger that can be utilized in the system of FIG. 13.
Figure 15:
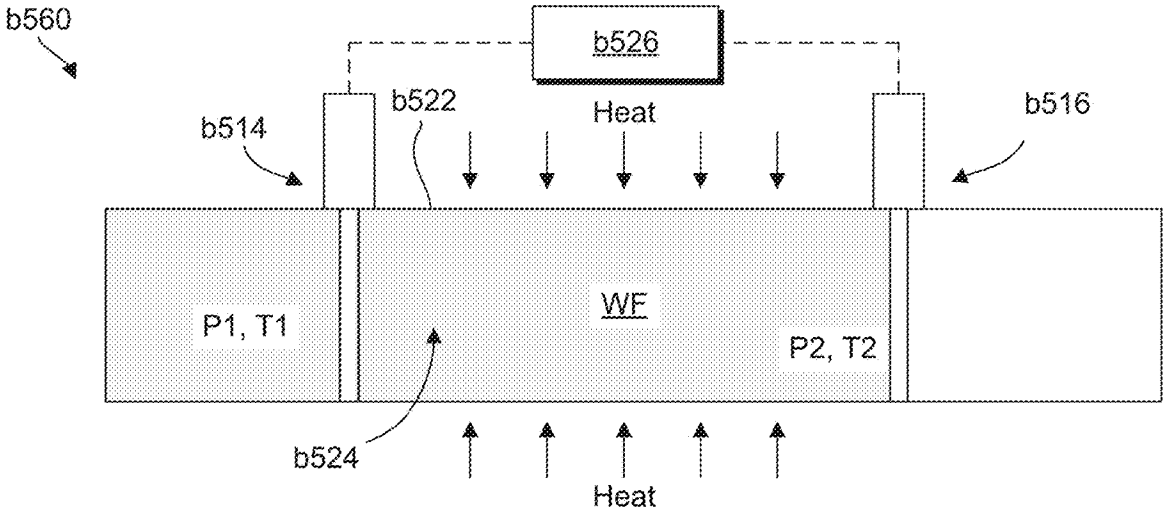

FIGS. 14 and 15 provide schematic close-up views of one embodiment of a constant density heat exchanger that can be utilized in the system of FIG. 13. In some embodiments, the system b550 (FIG. 13) includes one or more flow control devices. For instance, as depicted, the one or more flow control devices can include an inlet flow control device b514 and an outlet control device b516. The inlet flow control device b514 is positioned at an inlet b518 of a working chamber b524 defined by a housing b522 of the constant density heat exchanger b560. The outlet flow control device b516 is positioned at an outlet b520 of the working chamber b524. The one or more flow control devices b514, b516 are communicatively coupled with one or more controllers b526. The one or more flow control devices b514, b516 can be communicatively coupled with the one or more controllers b526 in any suitable manner, such as e.g., by one or more suitable wireless or wired communication links. The one or more controllers b526 are operatively configured to control the one or more flow control devices b514, b516. For instance, the one or more controllers b526 can send one or more command signals to the flow control devices, e.g., to move them to respective open positions or to respective closed positions. For instance, in FIG. 14, the flow control devices b518, b520 are shown in an open position in which the working fluid WF can flow into an out of the working chamber b524, and in contrast, in FIG. 15, the flow control devices b518, b520 are shown in a closed position in which the working fluid WF can neither flow into nor out of the working chamber b524.

An example heating cycle at constant or fixed density will now be described. As shown in FIG. 14, the one or more controllers b526 cause the inlet flow control device b514 and the outlet flow control device b516 to move to their respective open positions such that a volume of working fluid WF can flow out of the working chamber b524 (e.g., from a previous cycle) and a new volume of working fluid WF can flow into the working chamber b524. The one or more controllers b526 can cause the inlet flow control device b514 and the outlet flow control device b516 to move to their respective open positions substantially simultaneously. In yet other embodiments, the one or more controllers b526 can cause the outlet flow control device b516 and the inlet flow control device b514 to move to their respective open positions in such a way that one flow control device is opened a predetermined lag time behind the other. For instance, the one or more controllers b526 can cause the outlet flow control device b516 to move to the open position a predetermined lag time prior to causing the inlet flow control device b514 to move to the open position, or vice versa.

After the inlet flow control device b514 and outlet flow control device b516 are open for a predetermined open time or upon the working chamber b524 reaching a preselected volume of working fluid WF, the one or more controllers b526 cause the inlet flow control device b514 and the outlet flow control device b516 to move to their respective closed positions, e.g., as shown in FIG. 15. Notably, with the inlet flow control device b514 and the outlet flow control device b516 moved to their respective closed positions, the density of the working fluid WF within the working chamber b524 is held constant or fixed. That is, the working fluid WF is held at a constant density. As the working fluid WF is held at constant density, the heat source (e.g., combustion gases) applies heat to the working fluid WF within the working chamber b524. As noted above, the application of heat to the working fluid WF held at constant density increases the temperature and pressure of the working fluid WF, thereby increasing its potential energy.

After heating the working fluid WF at constant density for a predetermined heating time, the one or more controllers b526 cause the inlet flow control device b514 and the outlet flow control device b516 to move to their respective open positions. As will be appreciated with reference to FIG. 14, when the flow control devices are moved to their respective open positions, the working fluid WF heated at constant density exits the working chamber b524 and flows downstream, e.g., to the expansion device b256 of FIG. 13, and a new volume of working fluid WF flows into the working chamber such that it may be subjected to applied heat at constant density. The heating cycle continues or iterates during operation of the system.

Figure 16:
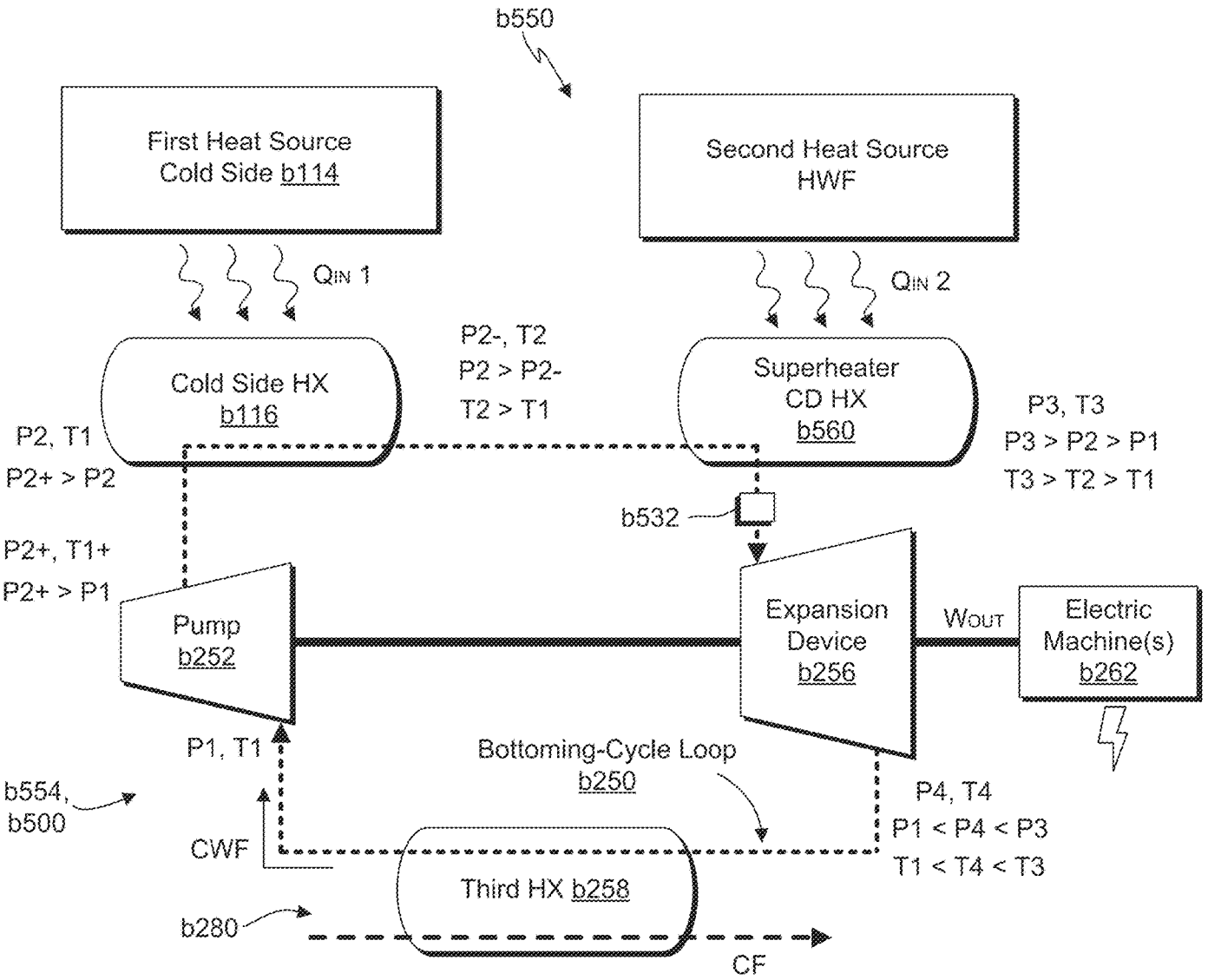
FIG. 16 provides a close-up schematic view of the bottoming-cycle system of the power generation system of FIG. 13.

FIG. 16 provides a close-up schematic view of the bottoming-cycle system b554 of the power generation system b550 of FIG. 13. As noted above, the bottoming-cycle system b554 is a Notarnicola cycle system b500 that operates on a constant density heat addition principle, or more concisely stated, on a Notarnicola Cycle. For instance, the bottoming-cycle system b554 described herein can include a constant density heat exchanger operable to hold a volume of working fluid at constant density during heat application. The working fluid can be a compressible fluid, for example. By applying heat to a working fluid held at constant density or substantially constant density, the temperature and pressure of the working fluid can be increased and thus its potential energy can be increased as well. Advantageously, the increased potential energy of the working fluid can allow for an expansion device or the like to extract more useful work therefrom.

Generally, the bottoming-cycle Notarnicola cycle system b554 includes a bottoming-cycle loop b250 along which a working fluid may flow, such as e.g., the chiller working fluid CWF. The chiller working fluid CWF can be supercritical fluid, such as e.g., supercritical carbon dioxide. In other embodiments, the chiller working fluid CWF can be another suitable working fluid. In some embodiments, the chiller working fluid is a compressible fluid.

The Notarnicola cycle system b500 includes various elements positioned along the bottoming-cycle loop b250. For the depicted embodiment of FIG. 16, the system includes a pump b252 operable to move the chiller working fluid CWF through the bottoming-cycle loop b250. The chiller working fluid CWF has a pressure P1 and a temperature T1 upstream of the pump b252 and downstream of the third heat exchanger b258. The chiller working fluid CWF has a pressure P2+ and a temperature T1 at the outlet of the pump b252. Notably, the pressure P2+ is greater than the pressure P1. Stated differently, the pressure P2+ of the chiller working fluid CWF exiting the pump b252 is greater than the pressure P1 of the chiller working fluid CWF entering the pump b252.

A cold side heat exchanger b116 is positioned downstream of and is in fluid communication with the pump b252. The cold side heat exchanger b116 receives the chiller working fluid CWF from the pump b252. The chiller working fluid CWF has a pressure P2 and a temperature T1 at the inlet of the cold side heat exchanger b116. The pressure P2 of the chiller working fluid CWF at the inlet of the cold side heat exchanger b116 is less than the pressure P2+ of the chiller working fluid CWF immediately downstream of the pump b252. Accordingly, the chiller working fluid CWF can suffer pressure losses while traveling from the pump b252 to the cold side heat exchanger b116. Notably, the cold side heat exchanger b116 is positioned in a heat exchange relationship with a first heat source, which in this embodiment is the cold side b114 of the closed cycle engine b110. In this way, heat can be extracted from the cold side b114 and used to heat the chiller working fluid CWF flowing through the bottoming-cycle loop b250. As shown in FIG. 16, heat captured from the cold side b114 of the closed cycle engine b110 and routed to the cold side heat exchanger b116 is denoted by $Q_{IN}$1. The captured heat imparts thermal energy to the chiller working fluid CWF flowing through the cold side heat exchanger b116, and accordingly, the temperature of the chiller working fluid CWF increases. Particularly, the chiller working fluid CWF exits the cold side heat exchanger b116 at a temperature T2 and a pressure P2−. Accordingly, the pressure of the chiller working fluid CWF flowing across the cold side heat exchanger b116 decreases while the temperature increases. That is, the pressure P2– is less than the pressure P2 and the temperature T2 is greater than the temperature T1.

A second heat exchanger or constant density heat exchanger b560 is positioned along the bottoming-cycle loop b250 downstream of the cold side heat exchanger b116. Accordingly, the constant density heat exchanger b560 receives the chiller working fluid CWF from the cold side heat exchanger b116. The constant density heat exchanger b560 is in a heat exchange relationship with a second heat source, which is the heating working fluid HWF (e.g., hot combustion gases) flowing along the heat recovery loop b214 of the heater loop b210 in this embodiment. As depicted in FIG. 16, recovered heat denoted by $Q_{IN}2$ is captured and routed to the constant density heat exchanger b560. The captured heat imparts thermal energy to the chiller working fluid CWF flowing through the constant density heat exchanger b560 while the volume of the working is held at constant density for a predetermined heating time.

As noted above, the constant density heat exchanger b560 is a constant density heat exchanger in this embodiment. Particularly, the constant density heat exchanger b560 is configured to hold a volume of chiller working fluid CWF at a constant density during heat application. Stated another way, the constant density heat exchanger b560 is a constant density heat exchanger operable to hold a volume of chiller working fluid CWF flowing therethrough constant or fixed while increasing, via a heat source (e.g., by the combustion gases passing through the constant density heat exchanger b560), the chiller working fluid CWF to a temperature T3 greater than the temperature T2 and the temperature T1. Furthermore, as the volume of the chiller working fluid CWF is held at constant density for a predetermined heating time, the constant density heat exchanger b560 is operable to increase, via the heat source, the chiller working fluid CWF to a pressure P3 that is greater than the pressure P2 and pressure P1. In some embodiments, the second heat exchanger can superheat the chiller working fluid CWF. The increased pressure and temperature of the chiller working fluid CWF increases the potential energy of the chiller working fluid CWF, and thus, more useful work can be extracted, e.g., by an expansion device b256. The constant density heat exchanger b560 can operate in the same or similar manner as described above with reference to FIGS. 14 and 15 and thus will not be repeated here.

Figure 17:
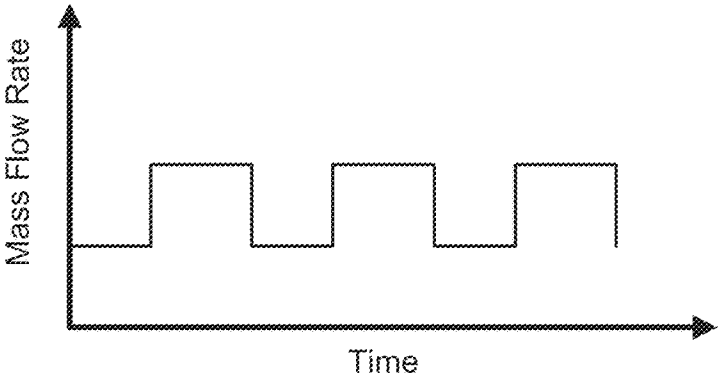
FIG. 17 graphically depicts the mass flow rate of the working fluid at the outlet of the constant density heat exchanger as a function of time.

As the chiller working fluid CWF is held at constant density for a predetermined heating time during heat application, the flow of chiller working fluid CWF exiting the constant density heat exchanger b560 is effectively pulsed out of the constant density heat exchanger b560. For instance, FIG. 17 graphically depicts the mass flow rate as a function of time of the chiller working fluid CWF exiting the constant density heat exchanger b560. As noted above, the chiller working fluid CWF exiting the constant density heat exchanger b560 exhibits pulse characteristics, which is embodied by the step wave shown in FIG. 17.

As depicted in FIG. 16, one or more pulse converters b532 can be positioned along the bottoming-cycle loop b250 between the constant density heat exchanger b560 and the expansion device b256. The one or more pulse converters b532 are operable to smooth out or dampen the pulsed flow of chiller working fluid CWF flowing downstream from the constant density heat exchanger b560. Particularly, the one or more pulse converters b532 are operable to dampen the pulsed flow to substantially a steady-state flow. In this way, the downstream expansion device b256 can receive a substantially steady-state flow of chiller working fluid CWF.

Figure 18:
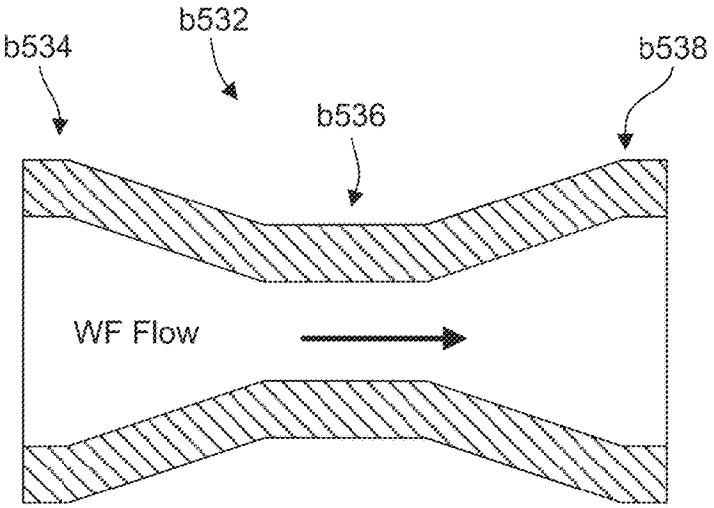
FIGS. 18 and 19 provide cross-sectional views of example pulse converters that can be utilized with Notarnicola cycle systems of the present disclosure.
Figure 19:
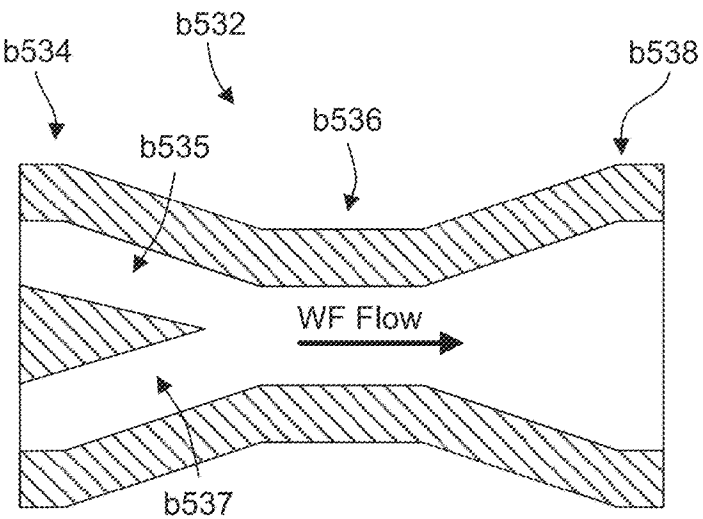

FIGS. 18 and 19 provide example pulse converters b532 that can be utilized with the system b500 of FIGS. 13 and 16. As depicted in FIG. 18, in some embodiments, the one or more pulse converters b532 can be configured as a Venturi-style nozzle having a converging nozzle b534, a throat b536, and a diverging diffuser b538. In the depicted embodiment of FIG. 18, the ejector nozzle b534 converges the working fluid WF, thereby increasing the static pressure of the working fluid WF. The working fluid WF then flows through the throat b536 of the pulse converter b532 and accelerates into the diffuser b538. The working fluid WF slows as it flows along the diffuser b538 and downstream to the expansion device b5256 (FIG. 13). Consequently, the pulsed flow exiting the constant density heat exchanger b560 can be smoothed out. That is, the working fluid WF exhibits a more steady state flow downstream of the pulse converter b532. Further, as depicted in FIG. 19, in some embodiments, the working fluid WF can enter the pulse converter b532 through multiple inlet conduits, such as the first inlet conduit b535 and a second inlet conduit b537. Although two inlet conduits are shown in FIG. 19, it will be appreciated that the working fluid WF can enter the pulse converter b532 through more than two inlet conduits. The multiple inlet conduits can facilitate smoothing of the working fluid WF by the pulse converter b532.

In some embodiments, at least two of the plurality of pulse converters b532 can be placed in series. In yet other embodiments, at least two of the plurality of pulse converters b532 can be placed in parallel. In some other embodiments, at least two pulse converters b532 can be placed in parallel with respect to one another and at least two pulse converters b532 can be placed in series. As noted above, such pulse converters b532 can dampen the pulsed flow of the working fluid WF exiting the constant density heat exchanger b560.

Returning to FIG. 16, as noted above, the bottoming-cycle system b554 embodied as a Notarnicola cycle system b500 also includes an expansion device b256 positioned downstream of the constant density heat exchanger b560. The expansion device b256 can be a turbine, for example. The expansion device b256 is operatively coupled with the pump b252 in this example embodiment. More specifically, the expansion device b256 is mechanically coupled with the pump b252 via a shaft or shaft system. Furthermore, the expansion device b256 is in fluid communication with the constant density heat exchanger b560. The expansion device b256 is operable to extract thermal energy from the chiller working fluid CWF to generate useful work, as denoted by $W_{OUT}$. Particularly, the expansion of the chiller working fluid CWF can drivingly rotate the expansion device b256 about its axis of rotation, which in turn drives the shaft and the pump b252 operatively coupled thereto. Moreover, when the shaft is driven by rotation of the expansion device b256, the useful work produced can be utilized to drive other components. For example, the useful work produced can drive a compressor of the closed cycle engine b110 operatively coupled with the expansion device b256 via a shaft. Consequently, heat from the closed cycle engine b110 can be utilized to produce work that can ultimately be utilized for driving one or more components of the closed cycle engine b110, such as e.g., compressors, fans, pumps, etc. Furthermore, for this embodiment, one or more electric machines b262 are operatively coupled with the expansion device b256. Accordingly, when the expansion device b256 is driven about its axis of rotation by expansion of the chiller working fluid CWF, the electric machines b262 operatively coupled with the expansion device b256 can generate electrical power.

When the working fluid exits the expansion device b256, the working fluid has a pressure P4 and a temperature T4. As depicted in FIG. 16, the pressure P4 is greater than the pressure P1 but less than the pressure P3. The pressure P4 is less than the pressure P3 due to the extraction of the energy from the working fluid by the expansion device b256. The temperature T4 is greater than the temperature T1 but less than the temperature T3. The temperature T4 is less than the temperature T3 due to the extraction of energy from the working fluid by the expansion device b256.

The system b554 also includes a third heat exchanger or third heat exchanger b258 positioned along the bottoming-cycle loop b250. The third heat exchanger b258 has an inlet and an outlet. The inlet of the third heat exchanger b258 is in fluid communication with the expansion device b256 and the outlet of the third heat exchanger b258 is in fluid communication with the pump b252. Accordingly, the third heat exchanger b258 is positioned downstream of and is in fluid communication with the expansion device b256 and the third heat exchanger b258 is positioned upstream of and is in fluid communication with the pump b252. Thus, the third heat exchanger b258 receives the working fluid from the expansion device b256 and the pump b252 receives the working fluid from the third heat exchanger b258. The third heat exchanger b258 is operable to decrease the temperature of the working fluid. In this way, the working fluid is better able to extract heat from the cold side b114 of the engine. As depicted, the third heat exchanger b258 is operable to decrease the temperature of the working fluid to a temperature T1, which is less than the temperature T4, the temperature T3, and the temperature T2. As the temperature decreases, the pressure of the working fluid decreases as well. As depicted, the pressure of the working fluid decreases to P1, which is less than the pressure P4, the pressure P3, and the pressure P2. A cooling fluid CF (e.g., air) flowing along the cooling loop b280 can be passed through the third heat exchanger b258 to remove heat from the chiller working fluid CWF flowing therethrough.

Figure 20:
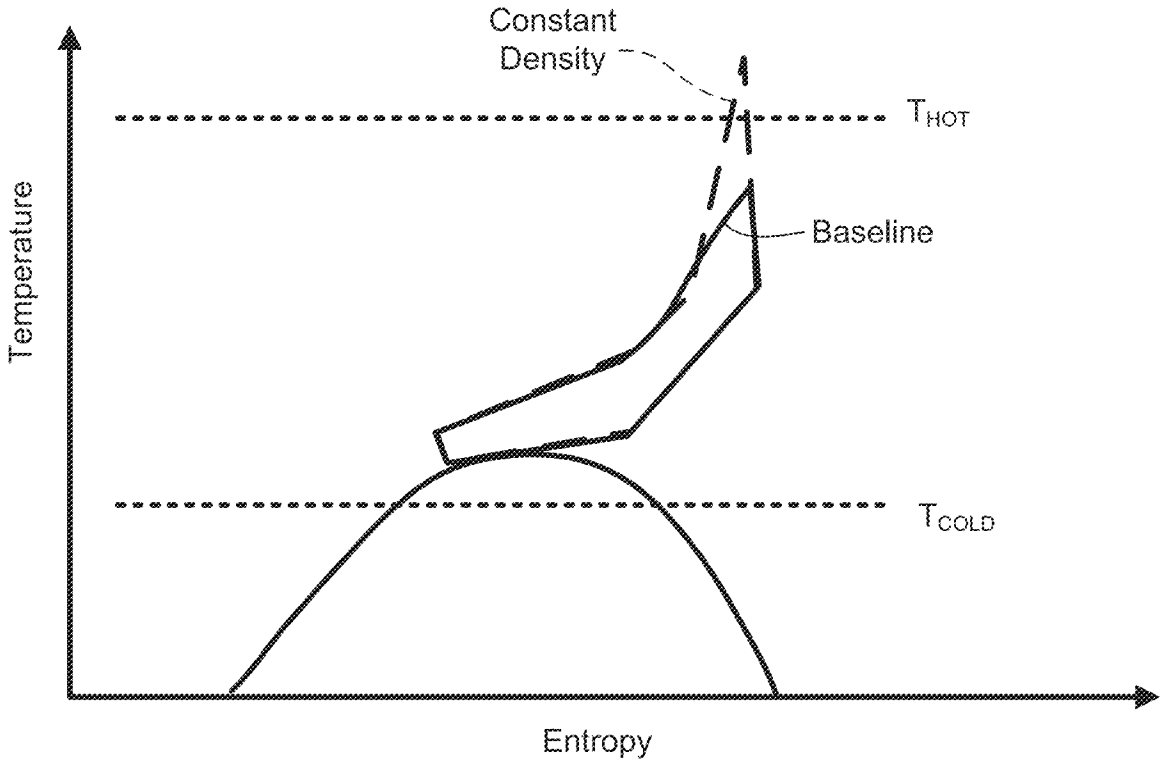
FIG. 20 graphically depicts the advantages of the constant density heat application process of a Notarnicola cycle system.

FIG. 20 depicts the advantages of the constant density heat application process described above. Particularly, FIG. 20 depicts a T-s diagram (i.e., a temperature-entropy diagram) of the closed cycle engine b110 utilizing the advantages of the constant density heat application process described above. As shown, using the constant density heat exchange process during super heating or reheating of the working fluid leads to a higher turbine inlet temperature, and therefore, more work out. This can be seen particularly on the T-s diagram where the constant density super heating causes the working fluid to increase isobars in temperature compared to a baseline system without constant density heat application. One benefit of the constant density heat exchange process is an increase of nearly twice the temperature difference across the expansion device b256 (FIG. 16) or turbine.

Figure 21:
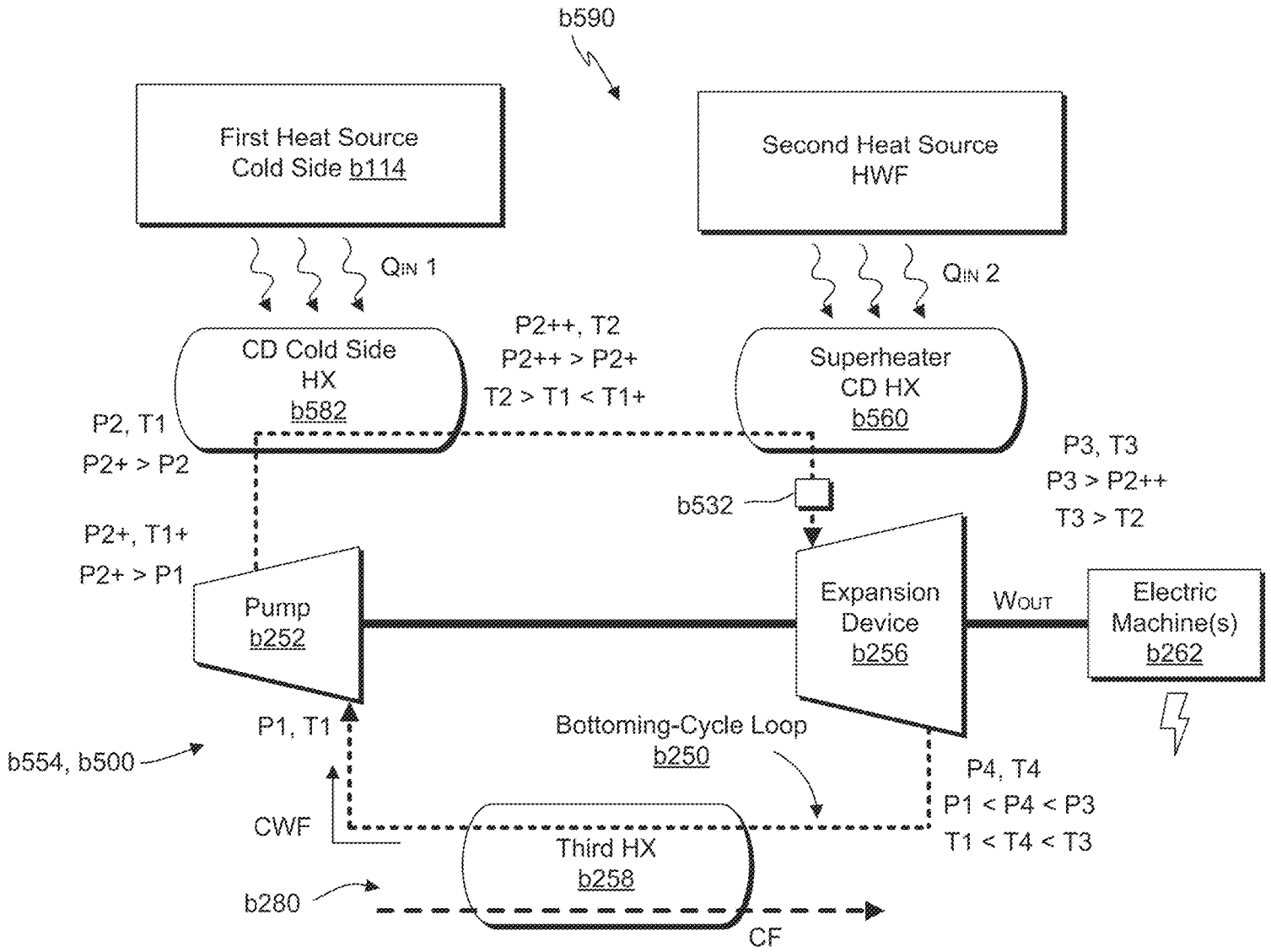
FIG. 21 provides a schematic view of another power generation system b100 according to an example embodiment of the present disclosure.

FIG. 21 provides a schematic view of another power generation system b590 according to an example embodiment of the present disclosure. The power generation system b590 depicted in FIG. 21 has a similar configuration to the system b550 of FIG. 16, except as provided below. Notably, for this embodiment, the cold side heat exchanger and the superheater are both constant density heat exchangers. Thus, the cold side heat exchanger is a constant density cold side heat exchanger b582 and the superheater is a constant density heat exchanger b560. The cold side constant density heat exchanger b582 and the constant density heat exchanger b560 can be configured and can operate in the same or similar manner as the constant density heat exchangers described above.

As shown in FIG. 21, for instance, the constant density cold side heat exchanger b582 is operable to hold a volume of working fluid (e.g., chiller working fluid CWF) at fixed density while increasing, via the heat source, the temperature and pressure of the working fluid. Particularly, the constant density cold side heat exchanger b582 is operable to hold the volume of working fluid at a fixed density while increasing, via the heat source (e.g., the heat extracted from the cold side b114 of the engine), i) the temperature of the working fluid such that an outlet temperature T2 of the working fluid is greater than the inlet temperature T1 of the working fluid; and ii) the pressure of the working fluid such that an outlet pressure P2++ of the working fluid is greater than the inlet pressure P2 of the working fluid. Thus, instead of a pressure drop across the cold side heat exchanger b116 (e.g., as occurs in the depicted embodiment of FIG. 16), the pressure of the working fluid is increased, e.g., from P2 to P2++).

Furthermore, the constant density heat exchanger b560 is operable to hold a volume of working fluid at fixed density while increasing, via the heat source, the temperature and pressure of the working fluid flowing along the bottoming-cycle loop b250. Particularly, the constant density heat exchanger b560 is operable to hold the volume of working fluid at a fixed density while increasing, via the heat source (e.g., heat from the hot side b112 of the closed cycle engine b110 and/or some other source), i) the temperature of the working fluid such that an outlet temperature T3 of the working fluid is greater than the inlet temperature T2 of the working fluid; and ii) the pressure of the working fluid such that an outlet pressure P3 of the working fluid is greater than the inlet pressure P2++ of the working fluid. By increasing the pressure of the working fluid at the constant density cold side heat exchanger b582 and at the constant density heat exchanger b560, the potential energy of the working fluid can be increased beyond what is achievable simply by heating the working fluid or by increasing its pressure by a single constant density heat exchanger, and thus, more useful work can be extracted, e.g., by the expansion device b256.

Computing System

Figure 22:
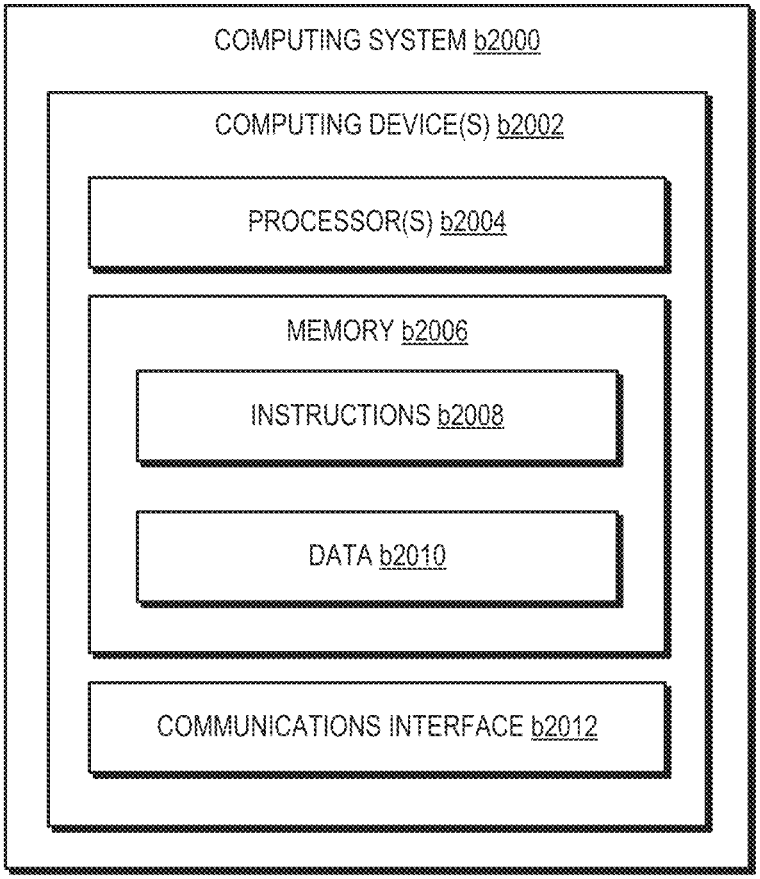
FIG. 22 provides an example computing system in accordance with an example embodiment of the present disclosure.

FIG. 22 provides an example computing system in accordance with an example embodiment of the present disclosure. The one or more controllers, computing devices, or other control devices described herein can include various components and perform various functions of the one or more computing devices of the computing system b2000 described below.

As shown in FIG. 22, the computing system b2000 can include one or more computing device(s) b2002. The computing device(s) b2002 can include one or more processor(s) b2004 and one or more memory device(s) b2006. The one or more processor(s) b2004 can include any suitable processing device, such as a microprocessor, microcontroller, integrated circuit, logic device, and/or other suitable processing device. The one or more memory device(s) b2006 can include one or more computer-readable media, including, but not limited to, non-transitory computer-readable media, RAM, ROM, hard drives, flash drives, and/or other memory devices.

The one or more memory device(s) b2006 can store information accessible by the one or more processor(s)

b2004, including computer-readable instructions b2008 that can be executed by the one or more processor(s) b2004. The instructions b2008 can be any set of instructions that when executed by the one or more processor(s) b2004, cause the one or more processor(s) b2004 to perform operations. In some embodiments, the instructions b2008 can be executed by the one or more processor(s) b2004 to cause the one or more processor(s) b2004 to perform operations, such as any of the operations and functions for which the computing system b2000 and/or the computing device(s) b2002 are configured, such as e.g., operations for controlling certain aspects of power generation systems and/or controlling one or more closed cycle engines as described herein. For instance, the methods described herein can be implemented in whole or in part by the computing system b2000. Accordingly, the method can be at least partially a computer-implemented method such that at least some of the steps of the method are performed by one or more computing devices, such as the exemplary computing device(s) b2002 of the computing system b2000. The instructions b2008 can be software written in any suitable programming language or can be implemented in hardware. Additionally, and/or alternatively, the instructions b2008 can be executed in logically and/or virtually separate threads on processor(s) b2004. The memory device(s) b2006 can further store data b2010 that can be accessed by the processor(s) b2004. For example, the data b2010 can include models, databases, etc.

The computing device(s) b2002 can also include a network interface b2012 used to communicate, for example, with the other components of system (e.g., via a network). The network interface b2012 can include any suitable components for interfacing with one or more network(s), including for example, transmitters, receivers, ports, controllers b1510, antennas, and/or other suitable components. One or more controllable devices b1534 and other controllers b1510 can be configured to receive one or more commands or data from the computing device(s) b2002 or provide one or more commands or data to the computing device(s) b2002.

The technology discussed herein makes reference to computer-based systems and actions taken by and information sent to and from computer-based systems. One of ordinary skill in the art will recognize that the inherent flexibility of computer-based systems allows for a great variety of possible configurations, combinations, and divisions of tasks and functionality between and among components. For instance, processes discussed herein can be implemented using a single computing device or multiple computing devices working in combination. Databases, memory, instructions, and applications can be implemented on a single system or distributed across multiple systems. Distributed components can operate sequentially or in parallel.

It should be appreciated that performances, power outputs, efficiencies, or temperature differentials at the system A10, the engine A100, or both, provided herein may be based on a "Sea Level Static" or "Standard Day" input air condition such as defined by the United States National Aeronautics and Space Administration, unless otherwise specified. For example, unless otherwise specified, conditions provided to the heater body, the chiller assembly, or both, or any subsystems, components, etc. therein, or any other portions of the system A10 receiving an input fluid, such as air, are based on Standard Day conditions.

The heat transfer relationships described herein may include thermal communication by conduction and/or convection. A heat transfer relationship may include a thermally conductive relationship that provides heat transfer through conduction (e.g., heat diffusion) between solid bodies and/or between a solid body and a fluid. Additionally, or in the alternative, a heat transfer relationship may include a thermally convective relationship that provides heat transfer through convection (e.g., heat transfer by bulk fluid flow) between a fluid and a solid body. It will be appreciated that convection generally includes a combination of a conduction (e.g., heat diffusion) and advection (e.g., heat transfer by bulk fluid flow). As used herein, reference to a thermally conductive relationship may include conduction and/or convection; whereas reference to a thermally convective relationship includes at least some convection.

A thermally conductive relationship may include thermal communication by conduction between a first solid body and a second solid body, between a first fluid and a first solid body, between the first solid body and a second fluid, and/or between the second solid body and a second fluid. For example, such conduction may provide heat transfer from a first fluid to a first solid body and/or from the first solid body to a second fluid. Additionally, or in the alternative, such conduction may provide heat transfer from a first fluid to a first solid body and/or through a first solid body (e.g., from one surface to another) and/or from the first solid body to a second solid body and/or through a second solid body (e.g., from one surface to another) and/or from the second solid body to a second fluid.

A thermally convective relationship may include thermal communication by convection (e.g., heat transfer by bulk fluid flow) between a first fluid and a first solid body, between the first solid body and a second fluid, and/or between a second solid body and a second fluid. For example, such convection may provide heat transfer from a first fluid to a first solid body and/or from the first solid body to a second fluid. Additionally, or in the alternative, such convection may provide heat transfer from a second solid body to a second fluid.

It will be appreciated that the terms "clockwise" and "counter-clockwise" are terms of convenience and are not to be limiting. Generally, the terms "clock-wise" and "counter-clockwise" have their ordinary meaning, and unless otherwise indicated refer to a direction with reference to a top-down or upright view. Clockwise and counter-clockwise elements may be interchanged without departing from the scope of the present disclosure.

Where temperatures, pressures, loads, phases, etc. are said to be substantially similar or uniform, it should be appreciated that it is understood that variations, leakages, or other minor differences in inputs or outputs may exist such that the differences may be considered negligible by one skilled in the art. Additionally, or alternatively, where temperatures or pressures are said to be uniform, i.e., a substantially uniform unit (e.g., a substantially uniform temperature at the plurality of chambers A221), it should be appreciated that in one embodiment, the substantially uniform unit is relative to an average operating condition, such as a phase of operation of the engine, or thermal energy flow from one fluid to another fluid, or from one surface to a fluid, or from one surface to another surface, or from one fluid to another surface, etc. For example, where a substantially uniform temperature is provided or removed to/from the plurality of chambers A221, A222, the temperature is relative to an average temperature over a phase of operation of the engine. As another example, where a substantially uniform thermal energy unit is provided or removed to/from the plurality of chambers A221, A222, the uniform thermal energy unit is relative to an average thermal energy supply from one fluid to another fluid relative to the structure, or plurality of structures, through which thermal energy transferred.

Various interfaces, such as mating surfaces, interfaces, points, flanges, etc. at which one or more monolithic bodies, or portions thereof, attach, couple, connect, or otherwise mate, may define or include seal interfaces, such as, but not limited to, labyrinth seals, grooves into which a seal is placed, crush seals, gaskets, vulcanizing silicone, etc., or other appropriate seal or sealing substance. Additionally, or alternatively, one or more of such interfaces may be coupled together via mechanical fasteners, such as, but not limited to, nuts, bolts, screws, tie rods, clamps, etc. In still additional or alternative embodiments, one or more of such interfaces may be coupled together via a joining or bonding processes, such as, but not limited to, welding, soldering, brazing, etc., or other appropriate joining process.

It should be appreciated that ratios, ranges, minimums, maximums, or limits generally, or combinations thereof, may provide structure with benefits not previously known in the art. As such, values below certain minimums described herein, or values above certain maximums described herein, may alter the function and/or structure of one or more components, features, or elements described herein. For example, ratios of volumes, surface area to volume, power output to volume, etc. below the ranges described herein may be insufficient for desired thermal energy transfer, such as to undesirably limit power output, efficiency, or Beale number. As another example, limits greater than those described herein may undesirably increase the size, dimensions, weight, or overall packaging of the system or engine, such as to undesirably limit the applications, apparatuses, vehicles, usability, utility, etc. in which the system or engine may be applied or operated. Still further, or alternatively, undesired increases in overall packaging may undesirably decrease efficiency of an overall system, application, apparatus, vehicle, etc. into which the engine may be installed, utilized, or otherwise operated. For example, although an engine may be constructed defining a similar or greater efficiency as described herein, such an engine may be of undesirable size, dimension, weight, or overall packaging such as to reduce an efficiency of the system into which the engine is installed. As such, obviation or transgression of one or more limits described herein, such as one or limits relative to features such as, but not limited to, heater conduits, chiller conduits A54, chamber volumes, walled conduit volumes, or operational temperatures, or combinations thereof, may undesirably alter such structures such as to change the function of the system or engine.

Although specific features of various embodiments may be shown in some drawings and not in others, this is for convenience only. In accordance with the principles of the present disclosure, any feature of a drawing may be referenced and/or claimed in combination with any feature of any other drawing.

This written description uses examples to describe the presently disclosed subject matter, including the best mode, and also to provide any person skilled in the art to practice the subject matter, including making and using any devices or systems and performing any incorporated methods. The patentable scope of the presently disclosed subject matter is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system, comprising:

a closed cycle engine defining a cold side;

a chiller loop having a bottoming-cycle loop;

a pump positioned along the bottoming-cycle loop and operable to move a working fluid along the bottoming-cycle loop;

a cold side heat exchanger positioned along the bottoming-cycle loop in fluid communication with the pump and positioned in a heat exchange relationship with the cold side of the closed cycle engine, wherein the working fluid exits the cold side heat exchanger at a first temperature and a first pressure;

a constant density heat exchanger positioned along the bottoming-cycle loop and downstream of the cold side heat exchanger, wherein the constant density heat exchanger is operable to hold a volume of the working fluid flowing therethrough at constant density during heat application via a heat source such that a temperature and a pressure of the volume of the working fluid is increased to a second temperature and a second pressure, wherein the second temperature is greater than the first temperature and the second pressure is greater than the first pressure;

an expansion device in fluid communication with the constant density heat exchanger, the expansion device operable to extract thermal energy from the working fluid to produce work; and a third heat exchanger positioned along the bottoming-cycle loop and having an inlet and an outlet, the inlet of the third heat exchanger in fluid communication with the expansion device and the outlet of the third heat exchanger in fluid communication with the pump, wherein the third heat exchanger is operable to decrease the working fluid to a third temperature that is less than the first temperature, wherein the closed cycle engine includes a hot side heat exchanger, and wherein the bottoming-cycle loop is not in a direct heat exchange relationship with the hot side heat exchanger.

2. The system of claim 1, wherein the volume of working fluid held at constant density is held within a working chamber of the constant density heat exchanger, and wherein the working chamber of the constant density heat exchanger is operable to iteratively receive volumes of working fluid.

3. The system of claim 2, wherein at least one of the volumes of working fluid received within the working chamber is held at constant density within the working chamber during heat application.

4. The system of claim 2, wherein each of the volumes of working fluid is held at constant density within the working chamber during heat application.

5. The system of claim 1, wherein the closed cycle engine is a regenerative heat engine.

6. The system of claim 1, wherein the constant density heat exchanger is operable to superheat the working fluid held at constant density during heat application.

7. The system of claim 1, wherein the working fluid is a supercritical fluid.

8. The system of claim 7, wherein the supercritical fluid is a supercritical carbon dioxide.

9. The system of claim 1, wherein the constant density heat exchanger is positioned between the cold side heat exchanger and the expansion device along the bottoming-cycle loop.

10. The system of claim 1, further comprising:

one or more pulse converters positioned downstream of the constant density heat exchanger and upstream of the expansion device, wherein the one or more pulse converters are operable to smooth a pulsed flow of the working fluid flowing downstream from the constant density heat exchanger to the expansion device.

11. The system of claim 1, further comprising:

one or more electric machines operatively coupled with the expansion device, the one or more electric machines operable to generate electrical power when the expansion device produces work.

12. The system of claim 1, wherein the constant density heat exchanger is one of a plurality of constant density heat exchangers positioned along the bottoming-cycle loop.

13. The system of claim 12, wherein the cold side heat exchanger is a constant density heat exchanger.

14. A system, comprising:

a closed cycle engine defining a cold side and a hot side;

a bottoming-cycle loop;

a pump positioned along the bottoming-cycle loop and operable to move a working fluid along the bottoming-cycle loop;

a cold side heat exchanger positioned along the bottoming-cycle loop in fluid communication with the pump and positioned in a heat exchange relationship with the cold side of the closed cycle engine, wherein the working fluid exits the cold side heat exchanger at a first temperature and a first pressure;

a constant density heat exchanger positioned along the bottoming-cycle loop and downstream of the cold side heat exchanger, wherein the constant density heat exchanger is operable to hold a volume of the working fluid flowing therethrough at constant density during heat application such that a temperature and a pressure of the volume of the working fluid is increased to a second temperature and a second pressure, wherein the second temperature is greater than the first temperature and the second pressure is greater than the first pressure;

an expansion device positioned along the bottoming-cycle loop and in fluid communication with the constant density heat exchanger, the expansion device operable to extract thermal energy from the working fluid to produce work; and a third heat exchanger positioned along the bottoming-cycle loop between the expansion device and the pump, wherein the third heat exchanger is operable to decrease the working fluid to a third temperature that is less than the first temperature, and wherein the bottoming-cycle loop is not in a direct heat exchange relationship with the hot side of the closed cycle engine.

15. A method, comprising:

operating a closed cycle engine, the closed cycle engine defining a cold side and a hot side;

flowing a working fluid through a bottoming-cycle loop positioned at least in part in a heat exchange relationship with the cold side of the closed cycle engine;

holding, via a constant density heat exchanger positioned along the bottoming-cycle loop, a volume of the working fluid flowing therethrough at constant density; and applying, via a heat source, heat to the volume of the working fluid held at constant density, wherein the bottoming-cycle loop is not in a direct heat exchange relationship with the hot side of the closed cycle engine.

16. The method of claim 15, wherein during applying, via the heat source, heat to the volume of the working fluid held at constant density, a temperature and a pressure of the volume of the working fluid is increased.

17. The method of claim 15, further comprising:

expanding, via an expansion device positioned along the bottoming-cycle loop and downstream of the constant density heat exchanger, the volume of working fluid heated at constant density.

18. The method of claim 15, further comprising:

causing the volume of working fluid heated at constant density to flow out of a working chamber of the constant density heat exchanger, wherein causing the volume of working fluid heated at constant density to flow out of the working chamber comprises moving an outlet flow control device positioned at an outlet of the working chamber to an open position.

19. The method of claim 15, further comprising:

causing the volume of working fluid to flow into a working chamber of the constant density heat exchanger, and wherein causing the volume of working fluid to flow into the working chamber comprises moving an inlet flow control device positioned at an inlet of the working chamber to an open position.

* * * * *